US009995002B2

(12) United States Patent
Greenwald

(10) Patent No.: US 9,995,002 B2
(45) Date of Patent: Jun. 12, 2018

(54) METHOD FOR THE SURFACE APPLICATION OF CHEMICAL COMPOUNDS TO BOTH SYNTHETIC AND NATURAL FIBERS AND A SYSTEM FOR SAME

(71) Applicant: ARGAMAN TECHNOLOGIES LTD., Jerusalem (IL)

(72) Inventor: Jerry Greenwald, Moshav Beit Gamliel (IL)

(73) Assignee: ARGAMAN TECHNOLOGIES LTD., Jerusalem (IL)

( * ) Notice: Subject to any disclaimer, the term of this patent is extended or adjusted under 35 U.S.C. 154(b) by 183 days.

(21) Appl. No.: 14/396,496

(22) PCT Filed: Apr. 24, 2013

(86) PCT No.: PCT/IL2013/050355

§ 371 (c)(1),
(2) Date: Oct. 23, 2014

(87) PCT Pub. No.: WO2013/160898

PCT Pub. Date: Oct. 31, 2013

(65) Prior Publication Data

US 2015/0140047 A1 May 21, 2015

Related U.S. Application Data

(60) Provisional application No. 61/637,285, filed on Apr. 24, 2012.

(51) Int. Cl.

| | |
|---|---|
| ***D06M 23/12*** | (2006.01) |
| ***D06M 11/83*** | (2006.01) |
| ***D06M 11/46*** | (2006.01) |
| ***D06M 11/45*** | (2006.01) |
| ***D06M 11/44*** | (2006.01) |
| ***D06M 11/38*** | (2006.01) |
| ***D06M 16/00*** | (2006.01) |
| ***D06M 23/08*** | (2006.01) |
| ***D06M 10/08*** | (2006.01) |
| ***D06M 10/06*** | (2006.01) |
| ***D06M 10/02*** | (2006.01) |
| ***A61K 31/00*** | (2006.01) |
| ***A61K 8/19*** | (2006.01) |
| ***D21H 17/63*** | (2006.01) |
| ***D21H 21/36*** | (2006.01) |

(52) U.S. Cl.

CPC ..... *D21H 17/63* (2013.01); *D06M 10/02* (2013.01); *D06M 10/06* (2013.01); *D06M 10/08* (2013.01); *D06M 11/38* (2013.01); *D06M 11/44* (2013.01); *D06M 11/45* (2013.01); *D06M 11/46* (2013.01); *D06M 11/83* (2013.01); *D06M 16/00* (2013.01); *D06M 23/08* (2013.01); *D06M 23/12* (2013.01); *D21H 21/36* (2013.01)

(58) Field of Classification Search
None
See application file for complete search history.

(56) References Cited

U.S. PATENT DOCUMENTS

| | | | | |
|---|---|---|---|---|
| 3,161,920 | A * | 12/1964 | Stalego | C03B 37/045 19/51 |
| 3,298,068 | A * | 1/1967 | Chaikin | D01G 99/00 19/66 R |
| 3,605,226 | A * | 9/1971 | Aronoff | D06B 3/10 118/34 |
| 4,013,406 | A | 3/1977 | Bayer | |
| 4,140,607 | A | 2/1979 | Kreiselmeier et al. | |
| 4,600,606 | A | 7/1986 | Mischutin | |
| 5,183,701 | A | 2/1993 | Jacobs et al. | |
| 5,981,066 | A | 11/1999 | Gabbay | |
| 6,100,207 | A * | 8/2000 | Dean | D04H 1/60 2/174 |
| 6,124,221 | A | 9/2000 | Gabbay | |

(Continued)

FOREIGN PATENT DOCUMENTS

| | | |
|---|---|---|
| CN | 1358244 | 7/2002 |
| CN | 1473987 | 2/2004 |

(Continued)

OTHER PUBLICATIONS

New Technologies in Textile Dyeing and Finishing, Mar. 2009, [retrieved on Aug. 1, 2013], retrived from the intemct:<URL:http://www.industryhk,org/english/fp/fp_hki/files/HKI_03_09_textile_e.pdf The Federation of Hong Kong Industries Home p. 01 Mar. 2009 (Mar. 1, 2009) p. 30 right col. (3 pages).

Perelshtein et al., "CuO-cotton nanocomposite: Formation, morphology and antibacterial activity" Surface & Coatings Tech. 204: 54-57, 2009.

Perelshtein et al., "Sonochemical coating of silver nanoparticles on textile fabrics (nylon, polyester and cotton) and their antibacterial activity", Nanotechnology, vol. 19, 2008.

(Continued)

*Primary Examiner* — Tracy Vivlemore
*Assistant Examiner* — Monica A Shin
(74) *Attorney, Agent, or Firm* — JMB Davis Ben-David

(57) ABSTRACT

The present invention relates to a surface treatment and a method for its application for the introduction of a wide variety of differentiating properties to fibersin sliver form through a surface treatment of said fibers. The system can accommodate chemical processes, sonochemical processes, and acoustic cavitation processes whereby the fibers are speckled or plated with at least one predetermined compound in a liquid medium to impart at least one desired property to the fibers and for the orderly inclusion of such treated fibers in sliver form having such properties in yarns, woven, knit, or non-woven textiles.

14 Claims, 10 Drawing Sheets

(56) References Cited

U.S. PATENT DOCUMENTS

| | | | | |
|---|---|---|---|---|
| 6,226,838 | B1 * | 5/2001 | Raasch | D01H 4/32 19/115 R |
| 6,482,424 | B1 | 11/2002 | Gabbay | |
| 6,951,616 | B2 | 10/2005 | Dahlberg | |
| 2004/0247653 | A1 * | 12/2004 | Gabbay | A01N 57/20 424/443 |
| 2006/0156476 | A1 * | 7/2006 | Arnold | D06B 7/02 8/125 |
| 2007/0190872 | A1 | 8/2007 | Weber et al. | |
| 2011/0016671 | A1 * | 1/2011 | Gaitan | D01G 99/00 19/66 R |
| 2011/0097957 | A1 * | 4/2011 | Gedanken | D06M 10/02 442/123 |
| 2011/0300767 | A1 | 12/2011 | Gedanken et al. | |

FOREIGN PATENT DOCUMENTS

| | | | | |
|---|---|---|---|---|
| CN | 1730803 | 2/2006 | | |
| CN | 101575798 | 11/2009 | | |
| CN | 102182056 | 9/2011 | | |
| EP | 1614796 | 1/2006 | | |
| GB | 591999 | 9/1947 | | |
| JP | S62 62940 | 3/1987 | | |
| JP | H0835164 | 2/1996 | | |
| JP | 2010 138536 | 6/2010 | | |
| WO | WO 95/17091 | 6/1995 | | |
| WO | WO 01/50859 | 7/2001 | | |
| WO | 2004/050979 | 6/2004 | | |
| WO | WO2007032001 | 2/2007 | | |
| WO | WO2007061423 | 5/2007 | | |
| WO | WO 2008140337 | A1 * 11/2008 | | C08L 97/005 |
| WO | WO 2010/001386 | 1/2010 | | |

OTHER PUBLICATIONS

Hadad et al, "Sonochemical deposition of silver nanoparticles on wool fibers", J. of Appl. Polymer Sci, 104:1732-1737, 2007.

Abbasi et al, "Synthesis and Characterization of Ag Nanoparticles@polyethylene fibers under ultrasound irradiation", Ultrasonics Sonochemistry, 19:853-857, 2012.

* cited by examiner

METHOD FOR THE SURFACE APPLICATION OF CHEMICAL COMPOUNDS TO BOTH SYNTHETIC AND NATURAL FIBERS AND A SYSTEM FOR SAME

CROSS-REFERENCE TO RELATED APPLICATIONS

This is the U.S. National Stage of International Application No. PCT/IL2013/050355, filed Apr. 24, 2013, which was published in English under PCT Article 21(2), which in turn claims the benefit of U.S. Patent Application No. 61/637,285, filed Apr. 24, 2012.

The present invention relates to surface treatment of individual fibers before the fibers are converted into a yarn or a textile, and a system for fiber treatment. The system allows for individual fibers to be treated with a wide variety of chemical compounds which bestow different properties to the individual fibers through surface treatment of the fibers. The system utilizes fiber in sliver form. The system can accommodate a chemical treatment process, a sonochemical process and an acoustic cavitation process whereby the individual fibers are speckled or plated with at least one predetermined chemical compound or composition in a liquid medium which can contain 1 percent w/w or more of the compound or composition that imparts at least one desired property to the treated fibers without requiring a binding agent. The system facilitates the orderly positioning of the fibers, enabling their inclusion within yarns, woven, knit, or non-woven textiles, prepared by existing, common manufacturing processes, providing a versatile platform for individual fiber treatment. The present invention relates to a method for treating such individual fibers so that they can be given different properties such as non-ignition, retarded ignition, fire retardance, pesticidal activity, including anti-bed bug activity, antimicrobial, UV inhibiting, wound healing, cosmetic, water proof activity, water resistance activity, electrical conductance activity and other physical and chemical properties and medical delivery properties and combinations thereof. The system allows for the treatment of any polymeric fibers or cellulose fibers or manufactured regenerated cellulose fibers, and ease of incorporation within a yarn, a thread, a woven, knit, or non-woven textile. Because individual fibers are treated, when the same are incorporated within a larger framework, for example, by being spun into yarns, the treatment is embedded within the layers of the article, e.g. within the yarn, providing for greater retention and lesser leaching of the incorporated treatments on the fibers. The applied treatment to the fibers incorporated within such yarns, fabrics, etc., are also therefore resistant to abrasion and resistant to diminished activity following repeated washing cycles.

BACKGROUND

Surface treatment of textile materials is to date accomplished when the textile pre-products are in the yarn state or in the completed cloth state or in some cases in the completed product state as is in the case when garments are dyed. Treatment of individual fibers has not to date been an industrially applicable treatment process. A post-treatment of fibers to change the morphology or add qualities to the fibers after growth in the case of cellulose fibers or extrusion as in polymeric or manufactured regenerated cellulose fibers is not an industrial process in the textile industry. Polymeric or manufactured regenerated cellulose fibers are extruded with the desired added qualities in their pre-extruded chemistry state such as in aramide nylon Nomex by DuPont for fire retardancy. Cellulose fibers are treated either in yarn form or in textiles to add the desired qualities such as ammoniated compounds used by Westex in fire retardancy where the textile is treated. Fiber in sliver state is also not used as a vehicle for adding qualities to fibers but rather as a partial step in the yarn manufacturing process. Described herein sliver is composed of fibers in a parallel orientation or ordered fashion and the system described allows for the retention of this ordered fashion while treating the fibers to add desired qualities.

The treatment of the fibers herein will result in either a continuous or a discontinuous coating which herein is denoted as plated for continuous coating and speckled for discontinuous coating.

One of the reasons for the lack of such an industrial process is the fact that when fibers come in contact with a liquid medium, the fibers can bundle into inseparable balls or the fibers can separate and reorient in an unpredictable manner. Further, the problem exists in that, depending upon the nature of the fibers, there may be poor interaction with the solubilized compound in terms of its surface attachment by chemical bond formation or a lack of exposure that will allow for the entire fibers to be treated such as is the case in a cotton ball when only the outer exposed fibers are likely to be treated and then the cotton ball becomes impossible to process.

Often a treatment at a fiber level makes spinning of a yarn difficult due to friction between the chemicals on the fibers and the yarn spinning machinery, as well. As such, treatment at a fiber level does not lend itself to industrial processes in yarn and textile production.

Fabrics which are surface treated can have very different qualities depending on the compounds and compositions used for surface treatment and the desired application for use of the fabrics. For example, textiles treated with inorganic insoluble compounds through an oxidation/reduction process or through sonochemical irradiation or through acoustic cavitation of metal oxides in particular and other inorganic insoluble or poorly insoluble compounds in general are often rough to the touch and have limited use to a consumer because of the feel of the finished product and the dusting of the chemicals that fall off the fabrics.

Even if the amount of chemical compounds that are applied to the fabric is limited to a minimally effective amount or to a nano-size particle, the feel of the fabric often is similar to that of very fine sand paper and therefore unappealing to the touch. Essentially every inorganic compound applied in this manner, such as, silver and silver oxide, copper and copper oxide, zinc and zinc oxide or any inorganic hydrated compound such as sodium borate (decahydrate), alumina trihydrate, magnesium hydroxide, red phosphorous, antimony trioxide, diatomaceous earth, or any other insoluble or poorly soluble compound, will often, when thus applied, provide a rough quality to the textile surface, which renders the textile product undesirable, especially when the textile product comes in contact with the skin.

Further, it is technically challenging to reduce the surface exposure of the surface-applied chemical compounds so that the user will not feel the rough surface when the product is in the form of a yarn or a textile to which such compounds are surface applied. The inorganic nature of most chemical compounds will cause a fractious surface.

Compounds that are attached to the outer surface of a textile are subject to abrasion, which in turn can lead to their dislodging or being scraped away. Since the goal in surface application of such compounds is to achieve reasonable loading at a desired critical level, the same may not be achieved with current methods. Surface application of insoluble particles to a textile or a yarn furthermore provide potentially undesirable color artifacts, or otherwise undesirable appearance and/or feel, resulting in a need to treat such surfaces, to, at least in part, hide the particle. Such masking procedures, however, typically result in loss of efficacy of the masked particles.

Surface treatment with certain classes of desirable compounds, moreover, is typically unsuccessful. The use of poorly water soluble compounds, for example, flame retardant compounds, with existing methods, results in the compounds being readily disassociated from the fabric to which they are applied. Such dissociation provides, in addition to a loss of function on the applied material, for an environmental hazard, as, for example, in surface applied clothing, whereby the compounds dissociate in wash water. Such compounds, for example, brominated flame retardant compounds, which until recently were very common, are now a subject of regulatory scrutiny, as the compounds persist in the environment, bio accumulate in the food chain, etc. (see: Kim Hooper, Jianwen She (2003). "*Lessons from the Polybrominated Diphenyl Ethers (PBDEs): Precautionary Principle, Primary Prevention, and the Value of Community-Based Body-Burden Monitoring Using Breast Milk". Environmental Health Perspectives* 111 (1). http://www.ehponline.org/members/2003/5438/5438.html). Clearly, the issue is not related to brominated flame retardant compounds, but rather to any poorly water soluble compound with potential toxicological effect.

For the above reasons the state of the art teaches away from processes for the surface treatment of textiles with poorly water soluble, or insoluble organic or inorganic compounds, and individual fiber treatment, in the current uncontrolled setting, would seem to be an even greater risk factor, given these considerations.

As yet there remains a need for the creation of fiber-based products incorporating poorly water soluble compounds or insoluble compounds, which do not suffer from the limitations described hereinabove. The ability to prepare fiber-based products incorporating poorly water soluble or insoluble compounds, including various natural and synthetic fibers which are non-toxic and provide for such incorporation in a minimally toxic environment while maintaining the activity and protection afforded by incorporating such compounds is as yet unattainable, as well.

SUMMARY AND DESCRIPTION OF THE INVENTION

As will be described hereinafter the present invention resolves the problems identified above by providing a new system which involves:

(a) Exposing individual fibers or slivers to a liquid medium promoting the chemical treatment of the individual fibers or slivers of the same to occur without changing the shape, orientation or arrangement within an array or a combination thereof of the fibers or fibers within the slivers;

(b) maintaining a parallel orientation of the fibers, or fibers within the slivers, while allowing for separation of individual fibers, or fibers within the slivers, while in the liquid medium;

(c) exposing the separated fibers to a sonochemical irradiation process or an acoustic cavitation process or a chemical reduction process and providing exposure of substantially each of the separated fibers to such processes, thereby facilitating treatment of substantially each of the separated fibers while maintaining the parallel orientation.

(d) treating substantially each of the separated fibers while maintaining the parallel orientation; and (e) reassembling the fibers within an array to form a sliver for use in forming yarns or non-woven materials In some embodiments, the systems and processes of this invention provide a means for overcoming the typical difficulty encountered when considering treating fibers via sonochemical, or acoustic cavitation methods making use of ultrasonic waves, which typically alter fiber orientation in the process of the same.

Acoustic cavitation processes as described herein, may, in some embodiments, be taken to refer to a process in which insoluble compounds or compositions in the presence of a fiber are exposed to a sound wave passed through a liquid medium at a specific frequency that stimulates the creation of bubbles. Without being bound by theory and as observed, these bubbles may collapse at very high pressures and temperatures and if a compound is contained within or proximal to one of these bubbles, the particles of the compound will be energized or influenced by the released energy emanating from the bubble at a very high speed. The chemical compound or composition does not undergo any chemical changes, but is attached to the fiber mechanically through a cavitation process that attaches the physical particle to the surface of the fiber by implanting the solid compound or composition in the fiber. Embodied methods for accomplishing acoustic cavitation include, inter alia, Acoustic cavitation and its chemical consequences By Kenneth S. Suslick, Yuri Didenko, Ming M. Fang, Taeghwan-Hyeon, Kenneth J. Kolbeck, William B. McNamara III, Millan M. Mdleleni and Mike Wong School of Chemical Sciences, University of Illinois at Urbana-Champaign, 600 S. Mathews Ave., Urbana, Ill. 61801, USA; Suslick, K. S. "Sonochemistry," Science 1990, 247, 1439-1445, and others, as will be appreciated by the skilled artisan.

Sonochemical reactions, as described herein, may, in some embodiments, be taken to refer to the process whereby fibers in the form of a sliver are made to travel through a canal which contains a primary soluble metal. A second compound, a reductant, is then added to the liquid which interacts with the primary solution. The reductant interacts with the primary solution and reduces from it a solid metal in the presence of the sliver. A sonotrode is then turned on to begin emitting radio waves, as described, into the solution while the reduction process is taking place. As the solid is reduced from the primary solution, the particles, while still in nano-size, are cavitated, like any insoluble particle, as described above. A common example of this would be a silver nitrate crystal dissolved in water as the primary solution in the presences of a fiber. Ammonia or another reductant such as sodium persulfate is then added to the solution with the fibers in the canal and is then exposed to the radio wave. As the silver reduces from the silver nitrate, particles of a solid silver or silver oxide are then immediately captured in the energy created by the bubbles, as described above, and are then cavitated into the fibers. In this process the metals are in solution, reduced to solids, and then cavitated like the insoluble compounds described above.

Oxidation/reduction chemical processes, as described herein, may, in some embodiments, be taken to refer to processes in which a metal in solution is precipitated from the solution using a chemical reductant and the metal (oxide)

is attached to fibers through van der Waals or polar bounds on to nucleation sights created on a fiber. For example, a copper oxide can be reduced from a copper sulphate solution using formaldehyde as a reductant and in the presence of fibers which have been pre-treated with a palladium dioxide solution the copper oxide will attach itself to the surface of the fibers. In order to facilitate this treatment the fibers must be aligned and pass through a spray or tank with the palladium dioxide solution, then in a tank that contains the copper sulphate solution and reductant. Treating up to 100% of the surface area of the fibers using the system is herein described.

The sonochemical and oxidation/reduction process described above is not limited to only a silver compound or a copper compound, which are given by way of example only, but can be applied to any solid insoluble or poorly soluble compound in solution that can be reduced to a solid from the solution as would be known to those familiar with the art or to any compound, whether organic or inorganic, which is insoluble or poorly soluble which will be directly applied to the fiber's surface.

Following treatment of the individual fibers, as described, the fibers are returned to a sliver state. In some embodiments, as referred to herein, the term "sliver" refers to a long bundle of fiber that is then spun into a yarn, which sliver is a collection of loose, untwisted parallel staple fibers. A sliver is created by carding or combing the staple fiber, which is then drawn into long strips in which the fiber is parallel within the bundle. Sliver formation is usually a preliminary process in yarn manufacturing.

The fibers are introduced, according to the process of the present invention, in the form of a standard sliver as described hereinafter.

This invention provides, in some embodiments, slivers with varying characteristics and methods of use thereof.

In some embodiments, the invention relates to the manipulation of a sliver, which facilitates surface modification of fibers of which such sliver is comprised, in a means whereby the fibers are spread apart, while still maintaining their parallel position and orientation, such that the fibers reassemble into a sliver after treatment, which in turn can be manipulated by standard processes to yield a final product containing a preponderance of individual surface modified fibers.

In some embodiments, this invention provides a process for the surface modification of a preponderance of fibers of which a sliver, yarn or textile is comprised, the process comprising:

(a) briefly exposing a sliver to an aqueous solution containing at least one component, for association with a surface of a preponderance of fibers in the sliver, for a time sufficient to allow separation between the fibers in the sliver;
(b) maintaining the orientation of the fibers while the fibers are in contact with the aqueous solution;
(c) providing conditions whereby the at least one component associates with a surface of a preponderance of the oriented fibers; and
(d) providing conditions such that a preponderance of the aqueous solution is removed from the fibers and the fibers reassemble into a sliver.

In some embodiments, the association of at least one component with a surface of a preponderance of oriented fibers, is accomplished via exposing the fibers, in contact with the aqueous solution, to acoustic cavitation or sonochemical irradiation or chemical reduction. According to this aspect, and in some embodiments, the conditions include exposing the sliver to the aqueous solution in the presence of piezoelectric transponders broadcasting at but not limited to about 15 to about 30 KHz frequency. According to this aspect, and in some embodiments, a surfactant can be added to the aqueous solution to further change surface qualities.

In some embodiments, the association of at least one component with a surface of a preponderance of oriented fibers, is accomplished via facilitation of a chemical reaction occurring between the fibers and the at least one component in the aqueous solution.

In some embodiments, the surface modification of a preponderance of fibers refers to a modification of a very small amount of change in the overall surface of the fiber.

For example, as demonstrated in U.S. 2004/0247653, it was found that as little as ½% of a surface of a fiber, in which was the appearance of a copper oxide compound, as a total percentage of appearance on the surface of a polymer, rendered the yarn and the fabrics into which these polymer based impregnated fibers were introduced, as enough to cause the fabric to be self-sterilizing and be highly effective against all bacteria, all fungi, and all viruses. Therefore it is learned that the surface modification can range from even less than 1% to as much as 100% of each fiber undergoing surface modification, depending on the time of exposure and the mode of exposure. In some embodiments, use of an oxidation/reduction process provided for 100% of the surface of the fibers being modified as demonstrated in U.S. Pat. No. 5,981,066.

In some embodiments, use of acoustic cavitation provides for the surface modification of fibers, which process may be controlled by varying such factors as the time of exposure, the size of the particles wherein preferably no less than 90% of the particles have a particle size of about 1 nanometer and about 5 microns, the amplification of the sonotrode, or pretreatment of the fibers by softening the surface of the fibers. In some embodiments, use of acoustic cavitation provides for a surface modification of fibers ranging from 1% of the surface of each fiber to as much as 95% of the surface of each fiber thus treated.

In some embodiments, briefly exposing the sliver to the aqueous solution is accomplished via immersion of the sliver in an aqueous solution containing at least one component intended for association with a surface of a preponderance of fibers in the sliver.

In some embodiments, the sliver is at least partially weighted while immersed in the aqueous solution in order to keep the open fibers from floating in the aqueous solution and altering the desired orientation.

In some embodiments, the sliver is trapped in a tightly bound two-sided web while immersed in the aqueous solution in order to keep the open fibers from floating and dispersing in the aqueous solution and altering the desired orientation. From SEM observation one can see in the figures attached a true penetration below the fiber surface by the insoluble particle into the actual fiber which is seen as a white dot in the cross section figures. In addition, one can observe in the figures attached a shadow around the attached particles on the fiber surface which indicates that a small portion of the non-soluble compound has pierced the surface so that the penetration can be as great as almost completely inside the fiber or as little as a few microns into the side of the fiber.

As demonstrated, it has been found that even after 50 washings and exposure to abrasion these particles remain in place which is the nature of a good mechanical (not chemical) bond. In conventional chemical treatments of cellulosic surfaces, such as electroless plating or covalent bond attachment, the chemical compounds which are attached to the outside of the fibers do not penetrate the surface but rather are kept on the surface by van der Waals bonds or covalent chemical connections which are generally very weak and will not withstand abrasion to the surface of the fiber.

In some embodiments, the process is automated and in some embodiments, the preponderance of the aqueous solution is removed from the fibers, which process to achieve the same includes subjecting the fibers to industrial squeezing processes.

In some embodiments, the process further comprises drying the sliver formed by reassembly of the fibers.

In particular the invention refers to but is not limited to a method and system for the application of inorganic insoluble compounds or compositions or insoluble organic compounds to treat fibers that will ultimately yield fire resistant textiles or textiles with other additional qualities.

Many of the chemicals used to impart flame resistance to textile materials, especially to thermoplastic textile substrates, are not water soluble and thus are usually applied by padding as aqueous dispersions or emulsions. Aqueous dispersions of poorly water soluble, non-phosphorus-containing brominated aromatic or cycloaliphatic organic compounds and a metal oxide together with a latex or other binder are described in U.S. Pat. No. 4,600,606. These dispersions or emulsions require high levels of dispersing agents, surfactants, and sometimes organic solvents, in order to function effectively. Even so, dispersion or emulsion stability is often very concentration dependent and sensitive to the presence of other additives in the application bath. Also, the dispersing agents, surfactants, and especially the organic solvents can cause other difficulties in the treatment process, for example color loss of a dyed textile substrate being finished in this manner.

Flame retardants are chemicals applied to fabrics or other materials to inhibit or suppress the combustion process. They interfere with combustion at various stages of the process e.g. during heating, decomposition, ignition and flame spread. Fire is a gas phase reaction. For a substance to burn, it must, at least in part, become a gas. As with any solid, a textile fabric exposed to a heat source experiences a temperature rise. If the temperature of the source (either radiative or gas flame) is high enough and the net rate of heat transfer to the fabric is great, pyrolytic decomposition of the fiber substrate will occur. The products of this decomposition include combustible gases, non-combustible gases and carbonaceous char. The combustible gases mix with the ambient air and its oxygen. The mixture ignites, yielding a flame, when its composition and temperature are favorable. Part of the heat generated within the flame is transferred to the fabric to sustain the burning process and part is lost to the surroundings. In the system to be discussed herewith the transition of the substrate is almost instantaneous as it moves from its original form to a carbon.

Flame retardant systems for synthetic or natural polymers can act physically and/or chemically by interfering at particular stages of burning:

(a) By cooling: Endothermic processes triggered by the flame retardants cool the substrate.

(b) By forming a protective layer: The heat transfer is impeded, fewer pyrolysis gases are evolved, and the oxygen is excluded.

(c) By dilution: Substances, which evolve inert gases on decomposition, dilute the fuel in the solid and gaseous phases. The concentrations of combustible gases fall under the ignition limit.

Reaction in the gas phase: The free radical mechanism of combustion processes which takes place in the gas phase could be interrupted by flame retardants.

Reaction in the solid phase: One mechanism is the accelerated breakdown of polymers.

There are many methods for applying flame retardants to textile fabrics. The application method used depends on the characteristics of the flame retardant being applied as well as on its interaction with the substrate. For example, flame retardants that are water soluble cannot be applied by an exhaustion system from aqueous baths since the compound applied has greater affinity for the aqueous bath as opposed to the substrate being treated. Also, water-soluble flame retardants which have low boiling points cannot be applied by pad/dry/cure techniques due to the high loss of material during the drying step.

Powder coating techniques have been used to apply a coating powder, usually a thermoplastic, more typically a thermosetting resin, onto a solid surface such as metal objects. Fluidized-bed coating and electrostatic powder-spray coating are but two illustrations. Powder-coating processes are fusion coating processes which require the powder particles to be fused or melted at some point in the coating process. The substrate to which they are applied must be capable of withstanding the temperatures needed to fuse or melt the coating powder particles, at least for short periods of time, which will allow the powder to bond mechanically with the thermoplastic to which it targeted and in specific, limited, usually surface areas.

Coating powders and powder-coating processes offer a number of significant advantages: they are essentially 100% non-volatile and no solvents or other undesired substances are given off during application and curing; the powders are ready to use and require no thinning or dilution with the attendant need for organic solvents; nor do they require complex emulsion or dispersion formulation. Coating thickness, hence flame resistance, can be easily controlled and the powder is well utilized. Overspray can be collected or filtered from the surrounding atmosphere and reapplied, an important consideration when the material applied is costly. Overspraying, however, is limited in terms of its durability and depth of treatment within the fabric, and the textile product is more abrasive because of a purely surface located treatment and thus, this application method has limited application. The processes and materials of this invention thus overcome such previous method and provide a superior method and product in lieu thereof.

In some embodiments, the flame retardants envisioned for use in accordance with the methods and materials of this invention may include, brominated flame retardants. chlorinated flame retardants, phosphorous-containing flame retardants, such as a phosphate ester, e.g., Tri phenyl phosphate, Nitrogen-containing flame retardants (i.e. Melamines), or inorganic flame retardants.

In some embodiments, the flame retardants envisioned for use in accordance with the methods and materials of this invention may include inorganic, organo-phosphorous, halogenated organic and/or nitrogen-based compounds. Halogenated organic flame retardants may include such organic flam retardants containing either Chlorine or Bromine, i.e. Brominated Flame Retardants (BFR). In some embodiments, the BFRs will include poly brominated diphenyl ethers {PBDE}, tetra bromobisphenol A {TBBPA} and hexabromocyclodecane {HBCD} The PBDEs which are contemplated for use in products are Deca, Octa, and Penta BDE. The concentration of BFRs in the products may range from about 5 to 30%. In some embodiments, the halogenated organic materials will not contain Iodine. In some embodiments, the flame retardants envisioned for use in accordance with the methods and materials of this invention may include antimony oxide. In some embodiments, the flame retardant will contain a halogen, particularly Chlorine and Bromine. In some embodiments, such flame retardants making use of a halogen oxide will contain a tri oxide, or in some embodiments, a pentoxide. In some embodiments, when polyesters are used as the polymeric component of the flame retardant material, alkaline salts of antimony oxides are used. In some embodiments, antimony oxide acts as a synergist with chlorine and bromine.

Antimony tri bromide is a dense white product and is one of the main components of the typical white smoke that is seen from burning polymers containing halogen and antimony oxide. High levels of water from normal combustion cause reversion of SbBr3 to HBR and Sb203. The remaining antimony oxide is then available to react with fresh HBR from a decomposing brominated compound. Typically compounds used in flame retardant applications contain either 40 to 70% Chlorine or 45 to 80% Bromine. The use of bromide compounds is very common in the fire retardant sphere but has limitations, and the Applicant has surprisingly found that the subject processes and materials provides for the incorporation of less noxious flame retardant compounds than those traditionally used.

In some embodiments, depending on the flame retardant being chosen for a particular application, from 20 to 40 parts of a brominated compound would be used per 100 parts of polymer. According to this aspect and in some embodiments, antimony oxide is typically included in an amount $\frac{1}{4}^{th}$ of that of the halogenated material.

A survey of the newer flame retardants suggests a simple theory for their constitution. The molecule should be poorly water soluble to achieve durability in laundering. A solvent-soluble organic molecule will give better results. The orthophosphate group should be present in the molecule to catalytically dehydrate the cellulose substrate. The molecule should contain polymerizable groups to affect a permanency of finish. The molecule should contain halogen or other groupings to reduce the flammability of the gases of decomposition. These types of compounds, which are presently used, are however, generally problematic. The attachment system described allows for the elimination of this type of chemistry on fibers and then into textile products to create a healthier, more stable, and environmentally clean product.

When chemical-free alternative materials or designs are not feasible, non-halogenated flame retardants can be used to meet fire safety standards. Numerous alternatives are available. It is also confirmed that flame retardants based on Alumina Trioxide, Ammonium Polyphosphates and Red phosphorous are less problematic in the environment. The system for attachment to fibers described herein allows the use of compounds that until now could not be used due the problem of attachment of those compounds to a substrate. As such, while these compounds can be applied within the system described, one familiar with the art would avail himself of the safer compounds.

One of the most preferred processes of applying fire retardants (FR) on cotton is the "Precondensate"/$NH_3$ process. This is an application of one of several phosphoniums "precondensates," after which the fabric is cured with ammonia, then oxidized with hydrogen peroxide. Precondensate is the designation for a Tetrakis-hydroxymethylphosphonium salt pre-reacted with urea or another nitrogenous material. The amount of anhydrous sodium acetate is approximately 4% of the amount of precondensate used. Some precondensates are formulated along with the sodium acetate. Softeners are also added along with precondensates.

The pH of the pad bath is approximately 5.0. The amount of flame retardant required depends primarily on fabric type and application conditions. Screening experiments are required to determine the minimum application level for a fabric. Application of FR to a fabric can be accomplished with conventional padding, padding with multiple dips and nips, followed by about 30 to 60 seconds dwell which has been show to yield good results. A critical factor in the successful application of a precondensate/$NH_3$ flame retardant is control of fabric moisture before ammoniation. Generally, moisture levels between 10% and 20% give good results. By way of example, the application to a textile as described herein is very common and in most textile finishing facilities the equipment used is basic to textile finishing techniques for other finishes generally used in commercial applications. The methods described herein allows for the elimination of these systems of application.

According to the present invention there has now been developed a functioning product and procedures for applying flame retardant chemicals in powder form onto fibrous substrates using an acoustic cavitation process or a sonochemical plating or speckling process, as described herein, which eliminates the use of any binders or encapsulating treatments, thus allowing the use of compounds or compositions having waters of hydration as a vehicle for flame retardation and non-ignition or retarded ignition of the substrate.

Thus according to the present invention there is now provided a surface treatment process, for the introduction of at least one predetermined property to a plurality of fibers through surface cavitation of the fibers while in a liquid medium, comprising introducing at least one predetermined compound or composition or chemical into the liquid medium, the chemical being chosen for its ability to impart at least one desired property to fibers treated therewith, and exposing the fibers to an acoustic cavitation or sonochemical irradiation process, while in the liquid medium, whereby the fibers are speckled or plated with the at least one predetermined compound or composition or chemical.

In one aspect, the present invention is based on compounds or compositions that release their waters of hydration as the temperature of the substrate rises, thus retarding combustion Thus according to a preferred aspect of the present invention there is now provided a non-ignitable polymeric or cellulose based fiber or manufactured regenerated cellulose fiber, on to which has been durably attached without the use of an adhesive or binding agent thru the acoustic cavitation process which occurs on the surface of the fibers and which will effect negatively the release of hydrated waters, a powdered poorly insoluble compound or composition, containing waters of hydration, which chemical is in solid form and which chemical may comprise, but is not limited to, alumina trihydrate, magnesium hydroxide, or sodium borate decahydrateor other hydrated insoluble compounds, which chemical is associated by cavitation with the surface of the cellulose or polymeric or manufactured regenerated cellulosic substrate, providing durable attachment of such chemical to the substrate In preferred embodiments of the present invention the chemical or composition is a hydrated inorganic salt.

In another aspect of the present invention there is provided a process of imparting a non-ignition or retarded ignition property to a fiber comprising applying to a cellulosic or polymeric or manufactured regenerated cellulosic substrate a poorly water soluble flame retarding composition containing waters of hydration, which composition is capable of attaching to the fiber-containing substrate through the use of a cavitation process as described herein.

In preferred embodiments the acoustic cavitation or sonochemical process is carried out using a continuous conveyor transport.

In another preferred aspect, the present invention relates to procedures for imparting very high flame resistance and a non-ignition quality or qualities derived from other compounds to fibrous substrates, and more particularly to textiles formed from such treated fibrous substrates by applying a hydrated inorganic salt to a substrate made from fibers, which salt is incorporated into the desired substrate by cavitation to impart the desired properties thereto and to textile products formed therefrom.

Thus according to the present invention there is provided a process for imparting a non-ignition property to a fiber substrate through surface cavitation of the fibers while in a liquid medium, comprising applying to a cellulosic or polymeric fibrous substrate a poorly water soluble flame retarding composition, containing a series of waters of hydration, the composition being capable of attaching to the fibrous substrate through the use of an acoustic cavitation or sonochemical process wherein in the process the fibers are exposed to the composition while traveling along a continuous conveyor.

Optionally the poorly water soluble flame retarding composition is a hydrated compound selected from the group consisting of sodium borate decahydrate, magnesium hydroxide, and alumina trihydrate.

In one aspect the present invention provides a system that utilizes the waters of hydration of an inorganic compound to control the combustion rate of the substrate. The effect of flame retardation is almost complete in that the substrate will turn from its raw state to carbon almost instantaneously when exposed to a high flame or heat source above the carbonization temperature of the substrate and thus reduce the transition state from raw material to carbon where smoke is generated and where flames can spread.

In some embodiments, the hydrated compound attaches directly to the substrate with no binder and is attached through cavitation to facilitate attachment of the compound to the substrate.

In some embodiments, of the present invention the hydrated chemical compound also contains at least one powdered compound that allows control of after-glow and will limit further any smoke reduction of the substrate when exposed to a flame In some embodiments, the hydrated compound is applied to a fibrous substrate at ambient temperature in an aqueous medium wherein the aqueous medium is exposed to a consecutive series of piezoelectric transponders or sonotrodes broadcasting at about 15 to about 30 KHz frequency which transponders are associated with an acoustic cavitation or sonochemical process, wherein in the process the fibers are exposed to the composition while travelling along a continuous conveyor and while being exposed to the compounds which are embedded in the sides of the fiber.

In some embodiments of the present invention there is provided a process of imparting flame resistance to ignition to a fibrous substrate comprising the successive steps of:

(a) introducing a powdered hydrated compound into an aqueous medium.

(b) transporting a fibrous sliver substrate along a moving conveyor belt or web configuration belt through the medium; and (c) exposing the aqueous medium to about 15 to about 30 KHz frequency until bubbling begins, wherein the powdered hydrated compound in the aqueous medium attaches itself to the substrate through cavitation.

Optionally step (a) is conducted at ambient temperature and the temperature of the aqueous medium is controlled along the moving conveyor belt to speed the cavitation process. Preferably, prior to step (a), the aqueous medium and the substrate are heated above ambient temperature prior to application of the powdered hydrated compound in step (a).

Optionally a surfactant is added to the aqueous medium to speed the cavitation process.

Optionally step (b) is conducted at a temperature in the range of from about 20° C. to about 60° C.

Optionally the hydrated compound is applied to a fibrous substrate at a temperature between about 20° C. and about 60° C. in an aqueous medium and the aqueous medium is exposed to a consecutive series of piezoelectric transponders broadcasting at an about 15 to about 30 KHz frequency associated with a water trough sized and configured to limit the dispersion of the fibers through which the substrate is passed.

The process for the application can be controlled so that the application can occur in as little as about 1 second and preferably less than about 10 minutes. The length of the conveyor built and the speed at which it is moving are factors in determining the exposure time. It has been found that only a small amount of the treated fibers introduced into a yarn or product are necessary to render a yarn produced from these fibers effective in the yarn or textile produced from same.

The cavitation process can be quickened by raising the temperature of the liquid carrier to between about 20° C. to about 60° C.

In addition, the process can be further quickened by adding less than about 1% of an ethanol solution and up to about 60% ethanol solution to a water carrier. For best results the liquid medium should be anionic water but drinkable tap water has been found to be sufficient.

In preferred embodiments of this aspect of the present invention, in addition to the hydrated compound, an additional compound, such as an organic phosphorous ester, such as tri-phenyl phosphate, as is, is added to the aqueous medium to inhibit afterglow of the substrate after loss of water of hydration and the charring of the substrate as a result of combustion.

Antimony trioxide can also be added to the chemical additive to enhance the fire retardant properties of the hydrated compounds as is known to those familiar with the art.

The invention also provides a cellulosic or polymeric fibrous substrate plated with a poorly water soluble flame retarding composition containing a series of waters of hydration.

The invention also provides a fibrous substrate having retarded ignition or non-ignition properties wherein the hydrated compound is directly attached to the substrate without binder.

Also provided is a non-ignitable polymeric or cellulose manufactured regenerated cellulose fiber into which has been incorporated a powdered poorly insoluble chemical, containing waters of hydration, which chemical is in solid form and which chemical is cavitated onto the cellulose or polymeric substrate to durably attach the chemical to the substrate, whenever produced by the process described above.

As is known to those familiar with the art, waters of hydration will be released from their molecule at varying temperatures. As an example, a molecule with a pentahydrate attachment or a decahydrate attachment will have 5 or 10 water molecules respectively attached to it. The mechanism for the release of these water molecules is generally exposure to varying levels of heat. In most cases, as the temperatures rise, the compounds will release more and more water molecules until their depletion which will occur when the last water molecule has been released. The substrates will be protected from carbonization because of these waters of hydration as long as the waters of hydration are physically in the compound. When the final water molecule is released from the compound the substrate will be consumed by the heat to which it is exposed. Provided the last water of hydration is released from the compound at a temperature which is higher than the carbonization temperature of the substrate there will be an instantaneous conversion of the substrate to carbon. While there will be no flame or smoke the substrate will immediately char. Once converted to carbon there can be no flame or spread of a flame from the now carbon source.

While this effect is known to people familiar with the art the problem is the attachment or inclusion of these compounds to the substrate. A further problem is experienced even if one succeeds through an oxidation/reduction chemical process to coat the substrate with these compounds because the physical appearance and touch of the substrate is radically altered by the attachment of these compounds to the substrate. Normally, the appearance is a change of color of the substrate to the hydrated compound which imparts a sand-paper type feel to the substrate. In addition, in all cases of chemical application there is a problem of resistance to abrasion of inorganic insoluble compounds when attached to the outside of any fiber.

According to the present invention there have now been found a system for limitation of discoloration and which also allows the textile material substrate to remain soft to the touch.

As stated hereinbefore the novel products of the present invention can be produced through the use of a sonochemical process or through a direct attachment using acoustic cavitation.

In order to guarantee a soft fabric it is necessary to apply the poorly water soluble or insoluble, preferably inorganic, hydrated chemistry such as sodium borate decahydrate, alumina trihydrate, magnesium dioxide and other compounds which have waters of hydration attached as part of the molecule to a fiber. This same system can be adapted to yarn, thread, or fabrics which will absorb the chemical compounds, however this will yield a very rough fabric to the touch. If done on a fiber level then the treated fibers are blended into a yarn. Since only a small percentage of the spun yarn is a treated fiber the roughness and the discoloration are reduced greatly or completely eliminated.

The invention is concerned with a surface treatment process for the introduction of at least one predetermined property to a plurality of cellulose fibers or manufactured regenerated cellulose fibers, or polymeric fibers, the fibers moving in a liquid medium in an ordered fashion, the process comprising the steps of:

introducing at least one predetermined poorly soluble compound or composition in powder form into the liquid medium, the at least one compound or composition being selected to impart the at least one desired property to the fibers treated therewith; and exposing the fibers while in the liquid medium to a process selected from a group of processes consisting of an acoustic cavitation process, a sonochemical irradiation process, and a chemical treatment process, whereby the fibers are plated or speckled with the at least one predetermined chemical compound or composition.

The at least one predetermined compound or composition is a poorly soluble compound or composition and no less than 90% of the powder has a size of between about 1 nanometer and about 5 microns.

No binding agent is used to attach the plated or speckled predetermined compound or composition to the fibers during the step of exposing.

The surface treatment can be for imparting non-ignition or retarded ignition to the fibers, wherein the at least one predetermined compound or composition is a poorly water soluble flame retarding compound or composition containing waters of hydration.

The poorly water soluble flame retarding compound or composition can be a hydrated compound selected from the group consisting of sodium borate decahydrate, magnesium hydroxide, and alumina trihydrate, or combinations thereof.

The surface treatment can be for imparting antimicrobial qualities including antibacterial, antifungal, and or antiviral qualities to the fibers, wherein the at least one compound or composition is a poorly water soluble antimicrobial compound or composition containing metals and/or oxides thereof. This antimicrobial surface treatment can be a metal or oxide thereof selected from the group consisting of silver, silver oxide, copper, copper oxide, magnesium, magnesium oxide, zinc, zinc oxide, or any combination thereof.

The surface treatment can be for imparting pesticidal qualities to the fibers, wherein the at least one predetermined compound or composition is selected from the group consisting of diatomaceous earth, copper oxide, silver, silver oxides, zinc, zinc oxide, or combinations thereof.

The surface treatment can be for imparting waterproof qualities to the fibers, wherein the at least one predetermined compound is a hydrophobic material. This hydrophobic material can be particles of ground silica.

The surface treatment's at least one predetermined compound or composition can be an encapsulated organic compound.

The surface treatment can be for imparting UV inhibiting qualities to the fibers, wherein the at least one predetermined compound or composition is selected from the group consisting of zinc oxide, titanium dioxide, diols, dicarboxylic acids, dicarboxylic acid derivatives, antimony, phosphorous, manganese, or combinations thereof.

The surface treatment can be for imparting medical properties to the fibers for transdermal medicinal transportation, or dermal treatment, wherein the compound or composition is selected from the group consisting of copper, copper oxides, silver, silver oxides, encapsulated organic compounds, or combinations thereof.

The surface treatment can be for imparting cosmetic properties to the fibers for dermal treatment, wherein the compound or composition is selected from the group consisting of copper, copper oxides, silver, silver oxides, encapsulated organic compounds, or combinations thereof.

The surface treatment can be obtained by the step of exposing further comprises a step of activating one or more transponders in acoustic communication with one or more sonotrodes at least partially submerged in the liquid medium, the sonotrodes emitting sound pressure waves at a frequency of about 15 to about 30 KHz for cavitation of the at least one poorly soluble compound onto the fibers.

The surface treatment of providing at least one poorly soluble compound can be effected by precipitation of a solid from the liquid medium by a oxidation-reduction chemical reaction or sonochemical reaction. This surface treatment process can further comprise a step of activating one or more transponders in acoustic communication with one or more sonotrodes at least partially submerged in the liquid medium, the sonotrodes emitting sound pressure waves at a frequency of about 15 to about 30 KHz for cavitation of the oxidation-reduction chemically or sonochemically initiated at least one poorly soluble compound onto the fibers of the sliver.

The surface treatment can be effected in the presence of a plurality of soluble compounds, where an oxidation-reduction reaction precipitates at least one solid onto the surface of the fibers of the sliver.

The surface treatment process can be performed wherein the liquid medium is held at a temperature in the range of about 20 C to about 60 C.

The surface treatment process can be performed wherein the step of exposing further comprises a step of transporting the fibers through the liquid medium in a trough, the fibers being transported on a transporting means selected from a moving belt, a moving film, a moving web, and a moving double web, the fibers being sandwiched between the two webs of the double web. In this surface treatment process, the step of exposing further comprises a step of at least partially weighing down the fiber to at least partially immerse it in the liquid medium so as to assist in maintaining exposure of the fibers in the liquid medium and maintaining an ordered orientation of the fibers of the sliver.

The surface treatment process can be performed wherein the liquid medium is water.

The surface treatment process can be performed wherein the step of exposing further comprises a step of adding a surfactant to the liquid medium in order to improve fiber separation during the surface treatment process and in order to assist in the reconstitution of the fibers into sliver.

The surface treatment process can be performed wherein the liquid medium contains 1 percent w/w or more of the at least one poorly soluble compound.

The invention is further concerned with a surface treatment process for treating a plurality of cellulose fibers or manufactured regenerated cellulose fibers, or polymeric fibers, comprising the steps of:

(a) providing at least one predetermined poorly soluble compound in a liquid medium;
(b) placing sliver on a transporting means;
(c) incrementally introducing the sliver into a trough within a surface treatment apparatus so that there is control of the sliver travelling within the liquid medium, and so that the sliver can be opened in an ordered fashion, exposing sufficient surface area of the individual fibers constituting the sliver to the at least one poorly soluble compound, thereby enabling effective plating or speckling of the fibers, and reconstitution of the fibers back to sliver.

The sliver weighs between about 2 to about 20 grams per running meter. The at least one predetermined poorly soluble compound is provided in powder form with at least 90% of the powder having a particle size of between about 1 nanometer to about 5 microns.

This surface treatment process can further comprise a step of activating one or more transponders in acoustic communication with one or more sonotrodes at least partially submerged in the liquid medium, the sonotrodes emitting sound pressure waves at a frequency of about 15 to about 30 KHz for cavitation of the at least one poorly soluble compound onto the fibers of the sliver.

This surface treatment process can further comprise the step of providing at least one poorly soluble compound is effected by precipitation of a solid from the liquid medium by a oxidation-reduction chemical reaction or sonochemical reaction. The surface treatment process can further comprise a step of activating one or more transponders in acoustic communication with one or more sonotrodes at least partially submerged in the liquid medium, the sonotrodes emitting sound pressure waves at a frequency of about 15 to about 30 KHz for cavitation of the oxidation-reduction chemically or sonochemically initiated at least one poorly soluble compound onto the fibers of the sliver.

The surface treatment process can be performed wherein transport of the fibers in the liquid medium is effected in the presence of a plurality of soluble compounds, where an oxidation-reduction reaction precipitates at least one solid onto the surface of the fibers of the sliver.

The surface treatment process can be performed wherein the liquid medium is held at a temperature in the range of about 20 C to about 60 C.

The surface treatment process can further comprise a step of transporting the fibers of sliver through the liquid medium in a trough sized and configured to limit the dispersion of the fibers, the fibers being transported on a transporting means selected from a moving belt, a moving film, a moving web, and a moving double web, the fibers being sandwiched between the two webs of the double web.

The surface treatment process can further comprise a step of at least partially weighing down the fiber to at least partially immerse it in the liquid medium so as to assist in maintaining exposure of the fibers in the liquid medium and maintaining an ordered orientation of the fibers in the step of introducing. The liquid medium may be water.

The surface treatment process can further comprise a step of adding a surfactant to the liquid medium in order to improve fiber separation during the surface treatment process and in order to assist in the reconstitution of the fibers to sliver form.

The surface treatment process can be performed wherein the liquid medium contains 1 percent w/w or more of the at least one poorly soluble compound.

The surface treatment process can further comprise a step of squeezing the fibers to assist in drying the fibers.

The surface treatment process can further comprise a step of exposing the fibers to heat for drying the fibers.

The surface treatment process can further comprise a step of winding the fibers after surface treatment, thereby facilitating reconstitution of the fibers to sliver form.

The surface treatment can be for imparting non-ignition or retarded ignition to the fibers, wherein the at least one predetermined compound or composition is a poorly water soluble flame retarding compound or composition containing waters of hydration.

The surface treatment process can be performed wherein the poorly water soluble flame retarding compound or composition is a hydrated compound selected from the group consisting of sodium borate decahydrate, magnesium hydroxide, and alumina trihydrate, or combinations thereof.

The surface treatment can be for imparting antimicrobial qualities including antibacterial, antifungal, and or antiviral qualities to the fibers, wherein the at least one compound or composition is a poorly water soluble antimicrobial compound or composition of compounds containing metals and/or oxides thereof.

The surface treatment process can be performed wherein the poorly water soluble antimicrobial compound or composition is a metal or oxide thereof selected from the group consisting of silver, silver oxide, copper, copper oxide, magnesium, magnesium oxide, zinc, zinc oxide, or any combination thereof.

The surface treatment can be for imparting pesticidal qualities to the fibers, wherein the at least one predetermined compound or composition is selected from the group consisting of diatomaceous earth, copper oxide, silver, silver oxides, zinc, zinc oxide, or combinations thereof.

The surface treatment can be for imparting waterproof qualities to the fibers, wherein the at least one predetermined compound is a hydrophobic material s The surface treatment process can be performed wherein the hydrophobic material are particles of ground silica.

The surface treatment process can be performed wherein the at least one predetermined compound or composition is an encapsulated organic compound.

The surface treatment can be for imparting UV inhibiting qualities to the fibers, wherein the at least one predetermined compound or composition selected from the group consisting of zinc oxide, titanium dioxide, diols, dicarboxylic acids, dicarboxylic acid derivatives, antimony, phosphorous, manganese, or combinations thereof.

The surface treatment can be for imparting medical properties to the fibers for transdermal medicinal transportation, or dermal treatment, wherein the compound or composition is selected from the group consisting of copper, copper oxides, silver, silver oxides, encapsulated organic compounds, or combinations thereof.

The surface treatment can be for imparting cosmetic properties to the fibers for dermal treatment, wherein the compound or composition is selected from the group consisting of copper, copper oxides, silver, silver oxides, encapsulated organic compounds, or combinations thereof.

U.S. Pat. No. 7,423,079 to Rogers et al discusses the application of super absorbent particles, in which these particles are used as the binder to render the chemistry attachable to the substrate. This differs from the technology discussed herein since no binder is used.

US Application 2007/0190872 Weber, et al discusses adding a plurality of FR compounds to a binder and curing the binder on the substrate. This differs from the technology discussed herein since no binder is used.

U.S. Pat. No. 4,298,509 Fochesato, Antonio discusses adding FR compounds to an olefin slurry. This differs from the technology discussed herein because it uses a multiplicity of FR compounds to obtain the desired effect.

U.S. Pat. No. 7,736,696 Piana, et al discusses the deposition of FR compounds on a fiber, yarn, or textile through a system similar to the application of a dye in a vat under pressure. This differs from the technology discussed, since the application discussed herein is a cavitation process, not a binding process.

EP20090160876 Rock, Moshe discusses the inclusion of a fire retardant (FR) fiber in a knitted or woven fabric that is in a fleece formation so that the FR element is on the outside of the fabric. The technology discussed applies to a finished textile, and does not teach or suggest a system for direct treatment of fibers.

PCT/US1999/021616 Rearick et al discusses the binding mechanism of a carboxylic acid-containing compound and a suitable catalyst for coupling the compound to some or all of the hydroxyl groups present on the materials and esterifying the hydroxyl groups to allow for attachment of an FR compound on cellulose. This differs from the technology discussed since the application discussed herein is a cavitation process, not a chemical binding process.

U.S. Pat. No. 4,600,606 to Mischutin relates to a process for rendering non-thermoplastic fibers and fibrous compositions flame resistant when contacted with a hot molten material that involves the application thereto of a flame retardant composition incorporating a poorly water soluble, non-phosphorous, solid, particulate mixture of brominated organic compound and a metal oxide or a metal oxide and metal hydrate.

U.S. Pat. No. 4,552,803 to Pearson relates to fire retardant compositions in the form of a powder that are produced from the following components: TBL Component Parts by Weight Aldehyde 70-140 Ammonium phosphate 50-250 Ammonium, alkali metal or 50-250 alkaline earth metal compound or salt Urea reactant 70-190 Hydroxy reactant 20-60 Phosphoric acid 150-250 Also provided are retardant compositions containing the powder and methods for treating substrates, such as paper or wood, as well as cotton, wool, and synthetic textiles to impart fire retardant properties thereto U.S. Pat. No. 4,468,495 to Pearson relates to fire retardant compositions in the form of a powder which are produced from the following components: TBL Component Parts by Weight Aldehyde 70-110 Ammonium phosphate 120-180 Ammonium sulfate 120-180 Urea 120-180 Alkanolamine 35-50 Phosphoric acid 100-150. Also provided are fire retardant compositions containing the powder, and methods for treating substrates such as paper or wood to impart fire retardant properties thereto.

U.S. Pat. No. 4,990,368 relates to flame retardant properties which are imparted to a textile substrate by application of a powdered flame retardant in solid form, which is then fused or melted onto the textile to durably attach the flame retardant to the textile. The process is especially adapted for poorly water soluble solid flame retardants, such as hexabromocyclododecane, currently applied in dispersion or emulsion form.

In IL 2009/00645 Gedanken et al. Sonochemical Coating of Textiles with Metal Oxide Nanoparticles for Antimicrobial Fabrics a laboratory process is described wherein a textile substrate approximately 100 square centimeters in size is placed in a beaker of water. Nanoparticles were used in the process and the description demonstrates a 1 hour dwell time for a full coating of the textile substrate. In the case of the treatment only the external surfaces of the textile receive the coating. In Gedanken only the surface of the fabric is coated and therefore can only result in a textile with a rough texture. In addition, as described in the cited reference, the process is very slow.

In contradistinction, according to the present invention there is produced a soft pliable effective product without the necessity of a nano-powder in a highly reduced time frame in a configuration that allows for mass production.

Further, in Gedanken the end product is a textile wherein the surface of the textile, not the surface of the fibers, is treated. This means that all the deposition of the chemical compounds is external. As a result, the fabric is rough to the hand and has a color.

U.S. Pat. No. 5,681,575 Burrell et. al discloses antimicrobial coatings and a method of forming the same on medical devices. The coatings are formed by depositing a biocompatible metal by vapor deposition techniques to produce atomic disorder in the coating such that a sustained release of metal ions, sufficient to produce an antimicrobial effect, is achieved. The medical device may be made of any suitable material, for example metals, including steel, aluminium and its alloys, latex, nylon, silicone, polyester, glass, ceramic, paper, cloth and other plastics and rubbers, and the coating is formed by physical vapor deposition, for example coating of one or more antimicrobial metals on the medical device by vacuum evaporation, sputtering, magnetron sputtering or ion plating.

WO2007/032001 Gedanken et al discusses a master batch level application using nanoparticles of silver. The targeted polymer is treated in pellet form using a sonochemical system and such pellets are then subsequently added to the slurry of a production system. Polymer pellets are treated for inclusion in a slurry, and this reference does not teach or suggest the attachment of desired chemicals through sonification directly to fibers. Thus, the reference is directed to a system for the inclusion of a nanoparticle particle in a master batch, not a direct cavitation application to fibers.

In another aspect of the present invention the at least one predetermined chemical is diatomaceous earth.

Thus in this aspect of the present invention there is provided a process for imparting pesticidal properties to a fibrous substrate comprising the successive steps of:

introducing diatomaceous earth into an aqueous medium transporting a fibrous sliver substrate along a moving conveyor beltor a moving film, or a moving web, or a moving double web, the fibers being sandwiched between the two webs of the double web through the medium; and exposing the aqueous medium to about 15 to about 30 KHz frequency until bubbling begins wherein the diatomaceous earth in the aqueous medium attaches itself to the substrate through cavitation.

In yet another aspect of the present invention the at least one predetermined chemical is selected from the group consisting of metal and metal oxides.

Optionally the chemical is selected from the group consisting of silver and its oxides, copper and its oxides, magnesium and its oxides, and zinc and its oxides.

Thus in this aspect of the present invention there is provided a process for imparting antibacterial, antifungal, and antiviral qualities to a fibrous substrate comprising the successive steps of:

introducing silver and its oxides, copper and its oxides, magnesium and its oxides, zinc and its oxides, or mixtures thereof into an aqueous medium transporting a fibrous sliver substrate along a moving conveyor beltor a moving film, or a moving web, or a moving double web, the fibers being sandwiched between the two webs of the double web through the medium; and exposing the aqueous medium to about 15 to about 30 KHz frequency until bubbling begins, wherein the silver or its oxides, copper or its oxides, zinc or its oxides, magnesium and its oxides, or mixtures thereof in the aqueous medium attaches itself to the substrate through cavitation.

In this aspect of the present invention there is also provided a process for imparting antimicrobial and UV inhibiting properties to a fibrous substrate comprising the successive steps of:

(a) introducing a chemical selected from the group consisting of zinc oxide, titanium dioxide, diols, dicarboxylic acids, dicarboxylic acid derivatives, antimony, phosphorous, manganese, or combinations thereof, MgO, CuO, Ag, and AgO or mixtures thereof into an aqueous medium.

(b) transporting a fibrous sliver substrate along a moving conveyor beltor a moving film, or a moving web, or a moving double web, the fibers being sandwiched between the two webs of the double web through the medium; and (c) exposing the aqueous medium to about 15 to about 30 KHz frequency until bubbling begins, wherein the zinc oxide, titanium dioxide, diols, dicarboxylic acids, dicarboxylic acid derivatives, antimony, phosphorous, manganese, or combinations thereof, MgO, CuO, Ag, and AgO or mixtures thereof in the aqueous medium attaches itself to the substrate through cavitation.

In yet another aspect of the present invention the at least one predetermined chemical is an encapsulated organic compound.

In this aspect of the invention the encapsulated organic compound is optionally selected from such substances as antibiotics or skin treatment compounds such as various creams or aloe vera.

Thus in this aspect of the present invention there is provided a process for introducing medicinal and cosmetic compounds for transdermal medicinal transportation or dermal treatment onto a fibrous substrate comprising the successive steps of:

(a) introducing an encapsulated organic compound into an aqueous medium.

(b) transporting a fibrous sliver substrate along a moving conveyor belt or a moving film, or a moving web, or a moving double web, the fibers being sandwiched between the two webs of the double web through the medium; and (c) exposing the aqueous medium to about 15 to about 30 KHz frequency until bubbling begins wherein the an encapsulated organic compounding the aqueous medium attaches itself to the substrate through cavitation.

As will be appreciated by the skilled artisan, therefore, the invention provides a sliver comprising a preponderance of fibers containing an associated component on a surface of the preponderance of fibers and such sliver will therefore have properties corresponding to those desired and effected by the choice of component associated therewith in accordance with the methods/processes as described herein. For example, such slivers and products incorporating the same may possess. antimicrobial properties, flame retardant or flame resistant properties, cosmetic enhancement properties, and others, as will be appreciated by the skilled artisan.

In some embodiments, the invention also provides a treatment apparatus for the introduction of at least one predetermined property to a plurality of fibers through surface cavitation of the fibers while in a liquid medium, the treatment process comprising:

(a) introducing a sliver into an orienting treatment apparatus, wherein:

i. the sliver is introduced incrementally into the apparatus within a canal or trough of sufficient width to permit sliver advancement therein, and to permit sliver dissociation to individual fibers; and ii. the canal or trough contains an orienting attachment that promotes substantially parallel orientation of the fibers and promotes immersion of the fibers within the canal or trough;

(b) introducing at least one predetermined chemical into liquid medium in a module of the treatment apparatus, wherein the chemical is chosen for its ability to impart at least one desired property to fibers treated therewith, (c) exposing the fibers to an acoustic cavitation or sonochemical irradiation process while in the liquid medium, whereby the fibers are plated with the at least one predetermined chemical; and (d) reassembling the individual fibers into a sliver in an assembly module of the orienting treatment apparatus;

whereby the sliver contains a plurality of fibers comprising surface incorporation of at least one predetermined chemical.

According to this aspect, and in some embodiments, the orienting treatment apparatus comprises weighted attachments serving as the orienting attachment.

According to this aspect, and in some embodiments, the apparatus comprises a winder, which facilitates reassembling the individual fibers into a sliver.

According to this aspect, and in some embodiments, the apparatus comprises squeeze rolls, which facilitate liquid removal from the treated fibers.

In some embodiments, FIG. 1 provides a description of an embodied layout for an apparatus of this invention. The skilled artisan will appreciate that such apparatus can readily be modified to incorporate industrially applicable equivalents for the various elements described herein. It will be understood that any apparatus, which provides for the ability to constrict individual fibers in a substantially oriented manner, while enabling immersion within a liquid medium, and providing for the acoustic cavitation or sonochemical irradiation of the individual fibers located therein and subsequent reassembly of such individually treated fibers within a sliver is envisioned herein, and is to be considered as part of this invention.

The invention will now be described in connection with certain embodiments with reference to the following illustrative figures and examples so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of one of the methods of the invention. In this regard, no attempt is made to show details of the invention in more detail than is necessary for a fundamental understanding of the invention, the description taken with the attached figures making apparent to those skilled in the art how the several forms of the invention may be embodied in practice.

DETAILED DESCRIPTION OF EMBODIMENTS OF THE INVENTION

Figure 1:
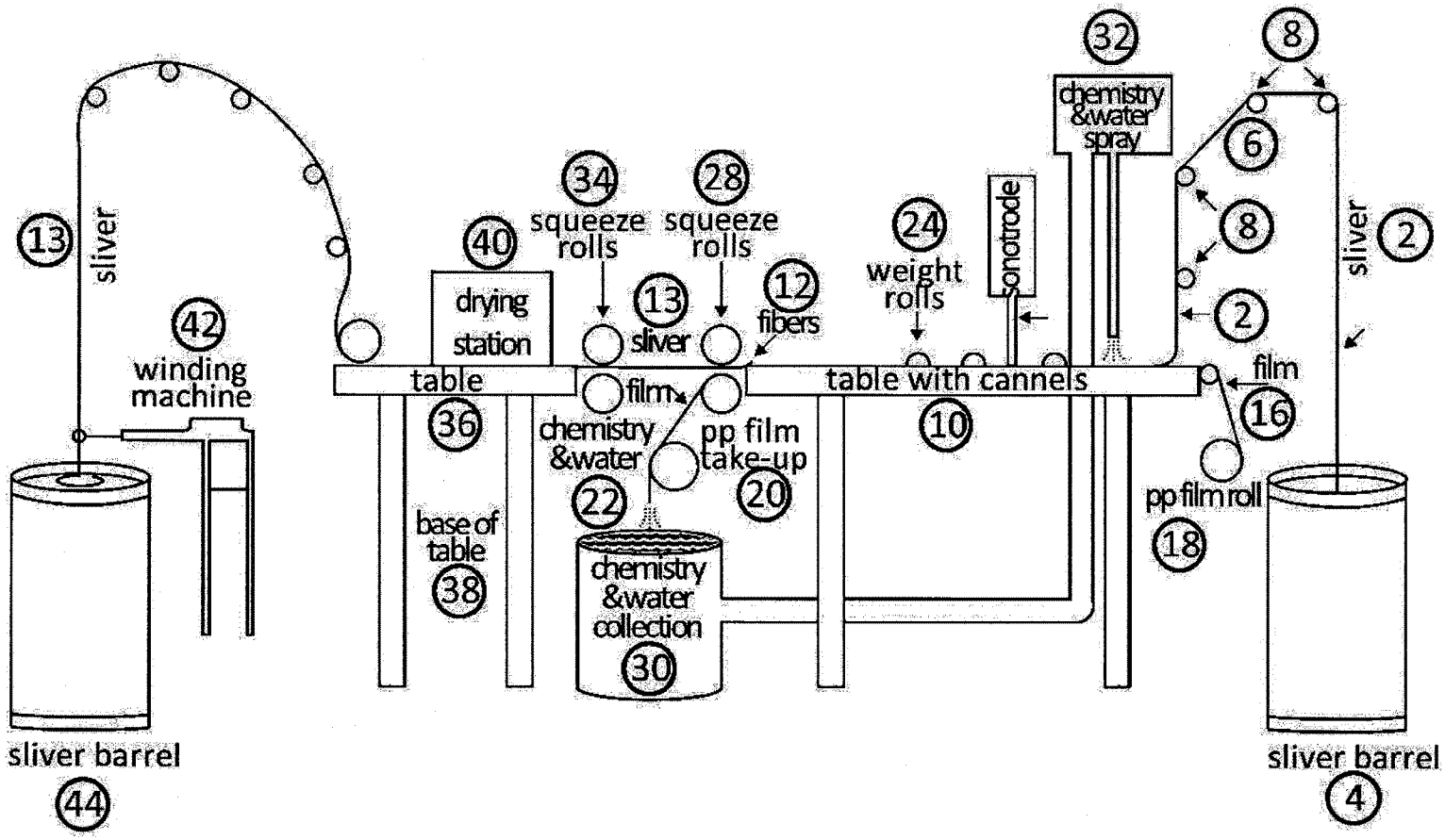
FIG. 1 is a schematic representation of a production line for carrying out the process of the present invention.
Figure 2:
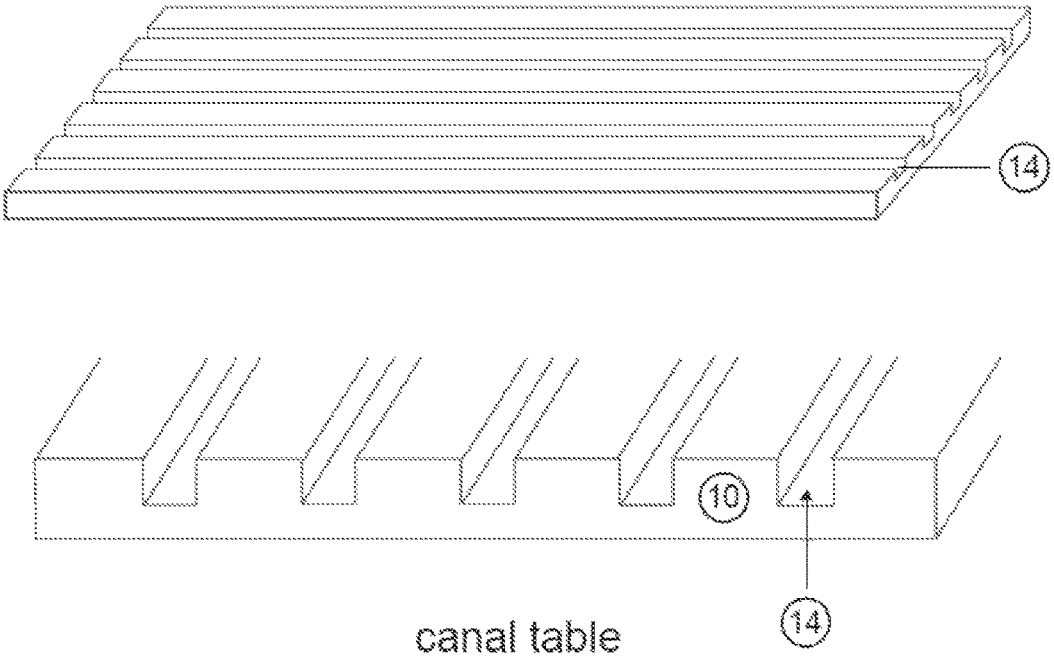
FIG. 2 is a partial exploded view of the canal table shown in FIG. 1.

Referring now to FIG. 1, fibers are prepared in the form of sliver (2), which slivers are, for example stored, as being wound in a barrel (4) as is common for the yarn production industry. The skilled artisan will appreciate that the source for the slivers and/or the maintenance of the same may be via any means and obtained from any source. The sliver is fed into the apparatus, for example, by leading the sliver through a track (6). The track may be supported at certain intervals, for example, by the presence of supporting metal rollers (8) that provide for the movement of the sliver (2) along the designated course, for example, as depicted herein, including passage over a fitted table (10). The apparatus and various support structures allow for incremental feeding of the sliver along the designated path, without breakage. Referring now to FIG. 2, which provides an exploded view of table (10) in FIG. 1, it can be seen that the table will be fitted with a series of indentations or recessed cells (14), which indentations/recessed cells are sized and of a material to allow for the housing of the aqueous solution therein. The sliver is guided along the length of the table (10), which table may incorporate an apically located film layer (16). Such film may, according to this aspect, be relatively hydrophobic in nature, for example, by being comprised of polypropylene or polyethylene. The film may in turn be fed along the surface of the table, much as the sliver is fed along the table, as a conduit providing smooth passage of the sliver. The film, in turn may be stored as a roll/reel, (18) which is in turn fed into a take-up reel (20) at the other side of the table (10). The sliver is then introduced on top of the film layer, as both are advanced along the length of the table. While it is not shown in this illustration it is possible to use a double flexible web such as a screen to catch the sliver and hold it in place as well. However, the system as described herein is simpler to construct.

Figure 4:
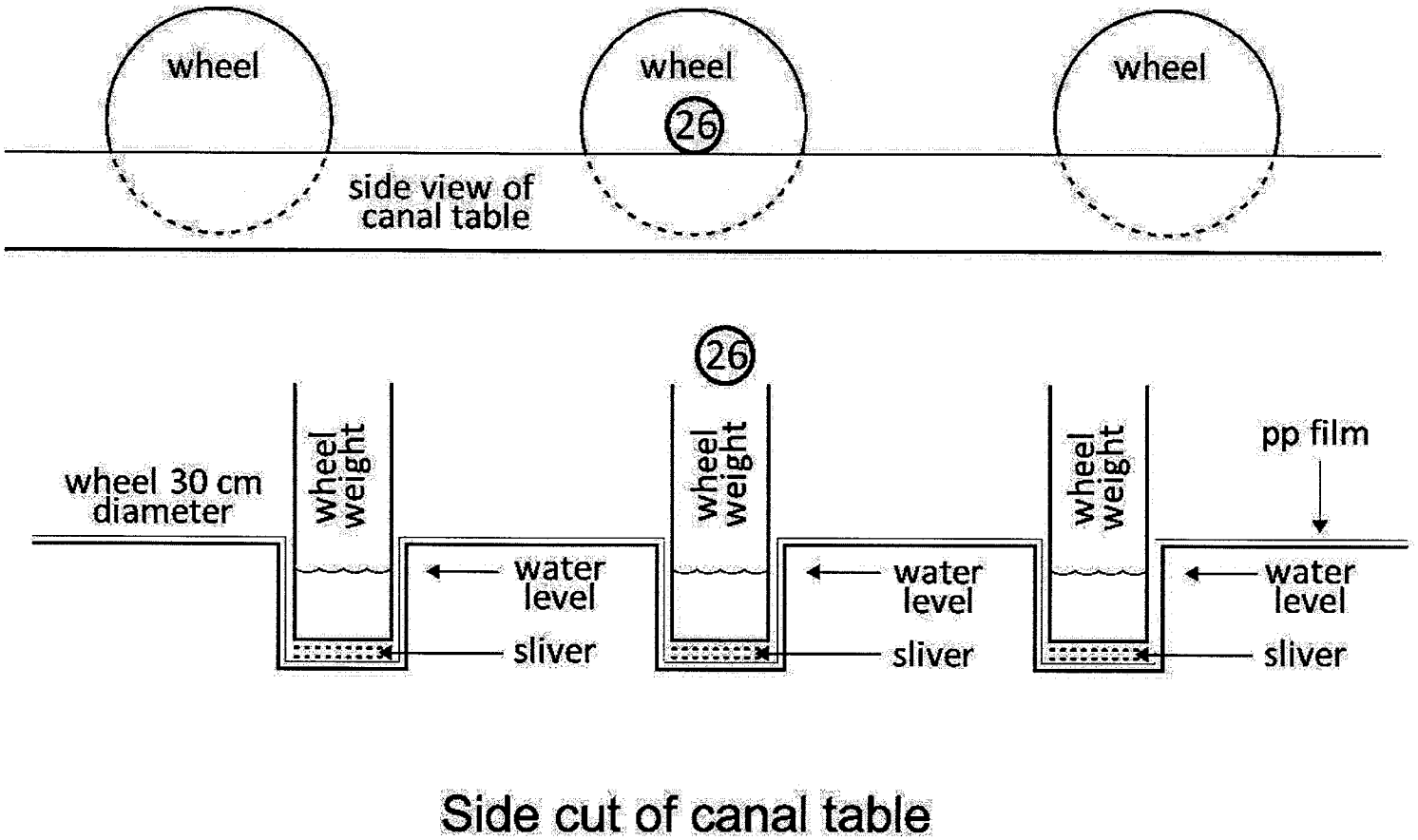
FIG. 4 is a side cut view of the table from FIG. 1 showing the position of the weight wheels

As the film carrying sliver is advanced, it comes into contact with the recesses/indentations in the table, and thereby becomes exposed to the aqueous solution contained therein (22). Since the sliver may have a tendency to float, which will interrupt the cavitation process, it may be necessary to weigh down the moving sliver. This may be achieved with the aid of some weight wheels (26) as depicted in FIG. 4 which fit in the canals (14) of the table (10). Upon exposure to the aqueous environment, the sliver comprising the fibers becomes fully wet and the fibers are then less tightly associated as compared to their orientation when dry. The sliver moves along the 1 meter table in around 15 seconds which is sufficient to affect the full cavitation desired. Spaces form between the fibers which spaces fill with water and which spaces act as the vehicle for fiber treatment because the fibers at this point are separated. The orientation will be maintained as long as the water remains undisturbed and the weight wheels (26) are parallel to the water canals (14). At this point, the fibers are completely separated. The timing of exposure of the sliver to the aqueous environment may be carefully controlled, ensuring that the fibers maintain ideal orientation in order to reform into a sliver with parallel-arranged fibers at the conclusion of the process. The timing of the immersion may also be a function of the speed of the carrier.

As the dry fibers move with the film (16) in the canals (14), water and chemicals (22) from chemical feed tank (32), are sprayed on the fibers to fill the canal or trough and cover the fibers (13) with liquid. The aqueous solution is sprayed at a very high pressure which submerges the fibers while also wetting them completely. The fibers will have a tendency to float so it is preferable to weigh them down with wheels (26) to at least partially immerse them in the liquid medium so as to assist in maintaining exposure of the fibers in the liquid medium and maintaining an ordered orientation of the fibers, or if more water is needed by adding extra spray nozzles. The process preferably occurs at a relatively high speed in order to prevent the natural tendency of the fibers to disperse and lose their orientation.

The fibers, in some embodiments, pass under a part of a sonotrode (24). In an embodiment it is possible to replace the sonotrode with a chemical dispenser so that the same machinery can be used for a chemical reduction processes.

According to this aspect, and in some embodiments, the processes of this invention may make further use of the periodic arrangement of weighting structures, such as weighting wheels 26, positioned over or at least partially over, or proximal to the positioning of the recesses/indentations in the table, which in turn may facilitate better fiber submersion.

According to this aspect, and in one embodiment of an apparatus which facilitates execution of the methods/processes of this invention, provides for passage of the fibers, as the fibers (13) leave the table (10) to pass through squeeze rolls (28) removing most of the water from the fibers (13) and compacting of the fibers back into sliver (12) form. It will be appreciated, however, that other arrangements may be utilized, whereby the film/sliver may be advanced along a surface, brought into periodic contact with the described aqueous solutions containing the component as described, which facilitates exposure of individual fibers in the sliver, whereby a preponderance of such fibers associate with the component, and ultimate reassembly of the sliver is accomplished, and such arrangements may not necessarily make use of automated parts, may be suitable for small scale applications, or alternatively may be modified to suit industrial applications, and all such arrangements are to be considered as contemplated and a part of this invention.

Furthermore, in some embodiments of the arrangement as described hereinabove, the water will flow down the rewinding film (16) into the collection tank (30) which water and chemicals (22) can then be recycled back to the water and chemicals feed tank (32) providing a cost-saving feature to the methods/processes as herein described.

In some embodiments, after the sliver (12) leaves the first set of squeeze rolls (28) the sliver is picked up by a second set of squeeze rolls (34) or any appropriate number of additional squeeze rolls, as a means of removing excess aqueous solution remaining in association with the film/sliver. After the first squeeze around 97% of the water is removed. The sliver is now in the form of a flat ribbon with parallel fibers. In this form the sliver can be moved to the next section for drying since the ribbon will have a small amount of integrity. This formation will now allow the sliver to move away from the supporting film and on to the belt that will enter the oven for drying. The sliver then travels on to the second table (36). The base (38) of this table (36) is a metal mesh so that the sliver sits on the mesh and travels with it allowing hot air to pass through the mesh and the moist sliver. The sliver enters the drying oven (40). As the sliver exits the drying oven the sliver then goes into a set of tracks that facilitates the sliver for winding (42) and entry into the collection sliver barrel (44).

Figure 3:
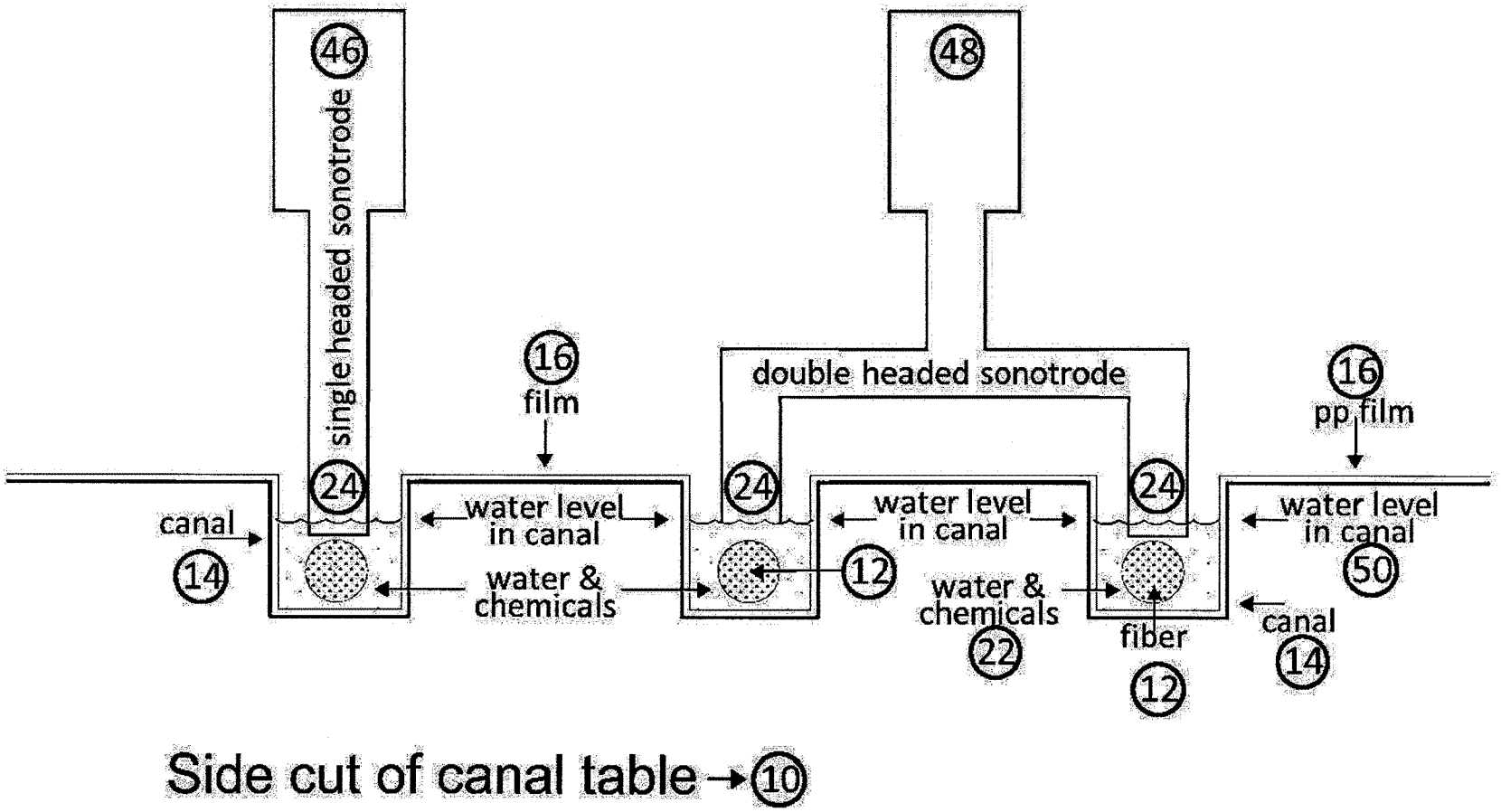
FIG. 3 is a side cut view of the table in FIG. 1 showing the position of the sonotrode in relation to the sliver and water

Referring now to FIG. 3 there are seen side views of two different sonotrodes within the canals (14) provided in table (10) in the apparatus of FIG. 1. As stated the fibers (13) in sliver form travel on a moving film or trapped in a moving web to catch the fibers so that they do not disperse unnecessarily due to exposure to the water (16) which is pressed into the canals (14). Two different sonotrode configurations, a single headed sonotrode (46) and a double headed sonotrode (48) and how they fit into the canal (14) are shown. The film (16), that travels, can be seen across the cut of the canal table (10)*as* well as the position of the fibers (13) in relationship to the film (16) the sonotrodes (46) and (48) and the water level (50) The waves that travel through the water will cause the fibers to loosen and open thus allowing full coverage by the chemicals in the water. There is only one sliver per trough.

EXAMPLES

Example 1

Fire Retardant Chemistry Containing Waters of Hydration

A sliver was prepared so that it had a slight twist (around 4 twists per meter) and weighed 3 to 8 grams per meter. The sliver can be made from any staple fiber such as but not limited to cotton, rayon, polyester, and nylon. The sliver was run through the system described but previous to the sliver being placed in the canals of the belt a small amount of Fire Retardant (FR) chemical compound in the form of a fine powder, usually no more than 5 microns in size, was placed in the water that was sprayed on the fibers. We note that the FR can also be put on the dry belt. The powder mixed into the aqueous carrier when the radio waves are turned on. The powder can be any hydrated insoluble compound, such as, but not limited to, sodium borate decahydrate or alumina trihydrate, In this case, we used a combination of alumina trihydrate and magnesium oxide and in a second example sodium borate decahydrate. The amount of chemical may be varied, depending upon the application, and as a consequence of the desired application density, cost, etc. Furthermore, it is possible to recycle the applied chemical by routing the excess chemicals to a collection tank. No more than 1 gram of powder per meter is required for the process, however more can be added to the water without reduction in the efficiency of the process. The fibers travel along the conveyor belt for as little as 15 seconds over a distance of 1 meter while being exposed to the acoustic irradiation during the entire duration of the time the fibers were in the water. It has been found that in as little as 1 second per meter, a 5 gram amount of cotton fiber was covered with no less than 30% surface modification. A bubbling around the fibers was observed indicating that cavitation took place. The fibers in the sliver immediately began to drift apart within the canal and separated. The fibers were found to remain orderly while in the canal when weight wheels (26) were placed every 25 to 50 centimeters and the fibers remained submerged. The sonotrodes were activated just before the sliver and water and hydrated compound were added to the conveyor belt. The sonotrodes remained on as long as the fibers, water, and chemicals were in the canal and continued their work for the length of the conveyor belt which was adjusted to assure an even coating over 100% of the fibers or as needed. After the coating was complete, the loose fibers were then quickly squeezed to remove almost all the water (the sliver was moist but condensed) and the sliver once again solidified and was moved to the drying station.

Non exemplified embodiments of such fibers can be prepared containing non-ignition or fire retardant properties imparted to the cellulose or polymer fiber substrate, which were then blended into a yarn using conventional techniques. This yarn was then woven into a fabric yielding a fire retardant fabric.

FIGS. 5, 6, 7, and 8 are SEM photographs demonstrating treated fibers both individually and included in a yarn and show the resistance to abrasion and washing after 50 washings by a process as described in Example 2 below.

Figure 5:
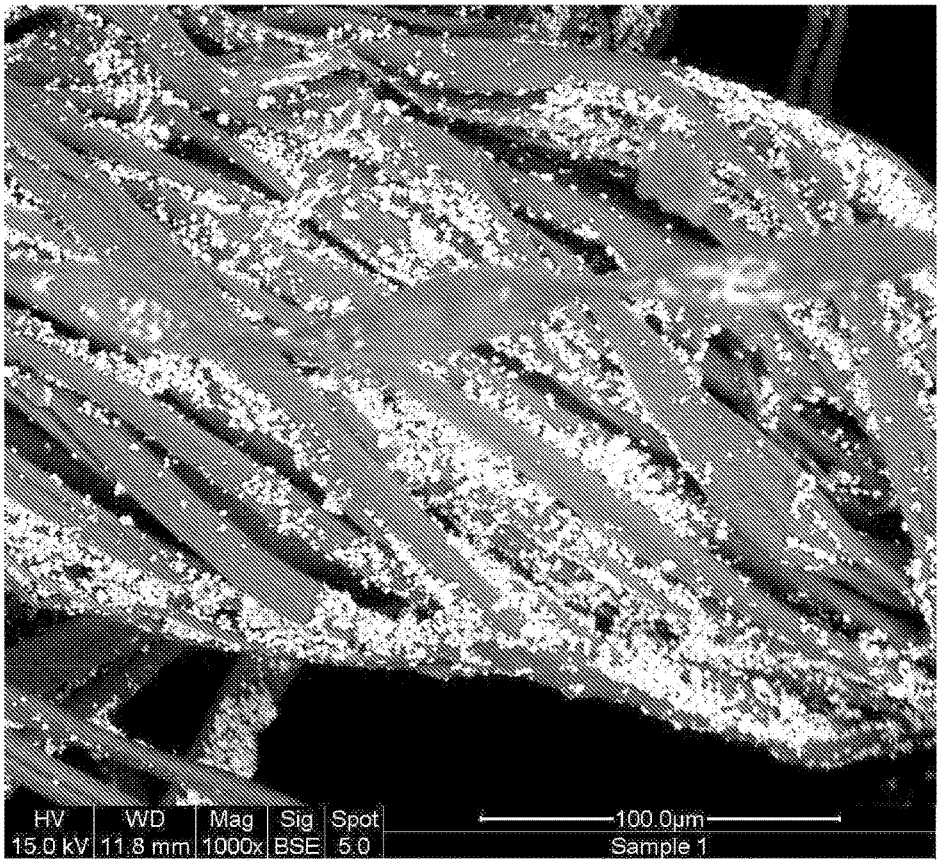
FIG. 5 is an SEM picture showing cavitated fibers spun into a yarn. Shown here are cavitated fibers with alumina trihydrate through an acoustic cavitation process.
Figure 6:
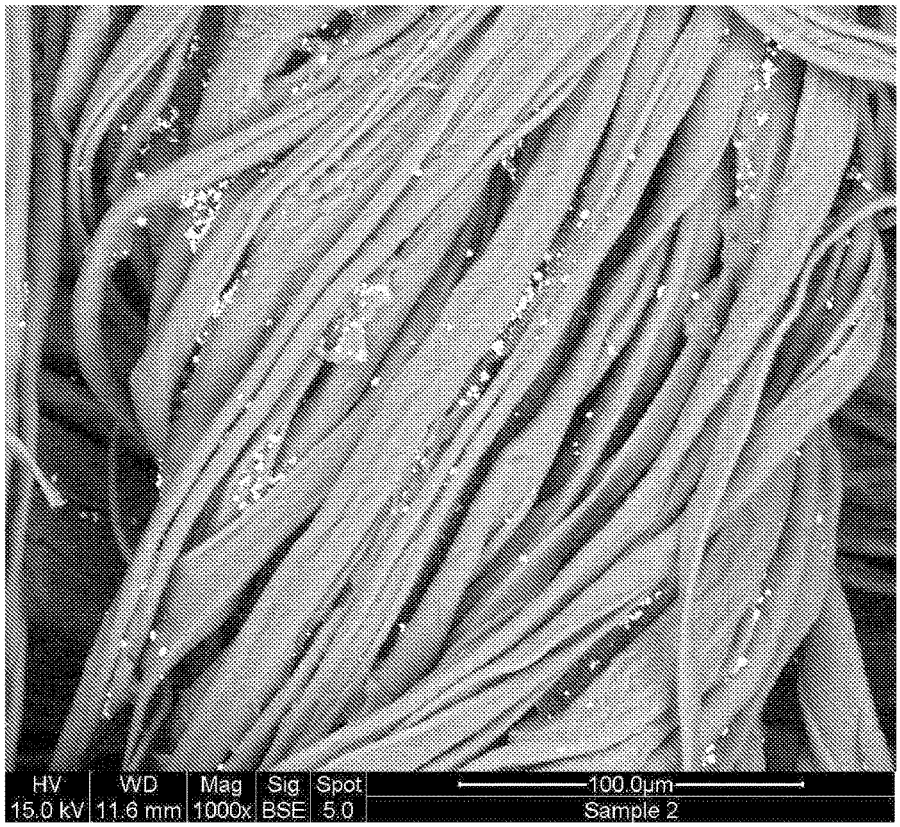
FIG. 6 is an SEM picture showing acoustically cavitated fibers applying alumina trihydrate which were spun into a yarn after 50 washings. The fibers did not ignite indicating a product lasting for the life of the product.

FIG. 5 shows a fiber immediately after cavitation while FIG. 6 shows the same fiber after extensive (50) high temperature washings (60 Centigrade). In sample 5 there was no ignition of the fiber when treated with both alumina trihydrate and magnesium hydroxide. The same non-ignition occurred in the yarn of FIG. 6 indicating a life of the fabric efficacy.

Figure 7:
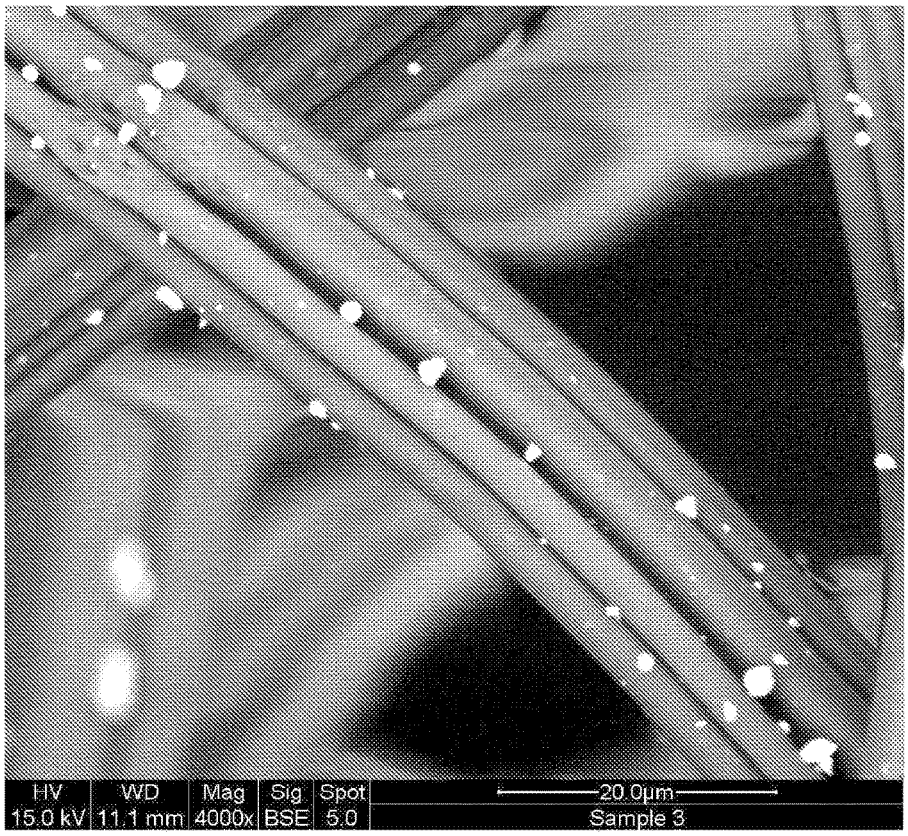
FIG. 7 is an SEM picture showing a single fiber after exposing it to acoustic cavitation.
Figure 8:
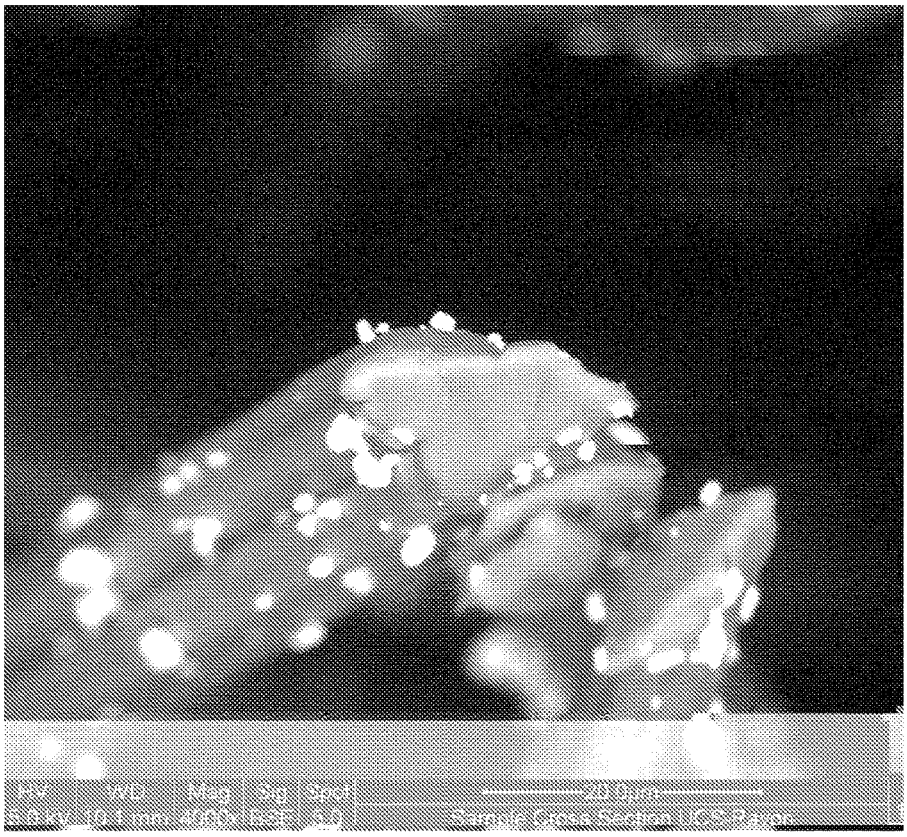
FIG. 8 is an SEM picture showing a cross section of a single fiber after exposing it to acoustic cavitation. Note that the white dots are the chemical compound which can be seen to have penetrated the surface of the fibers deeply.

FIGS. 7 and 8 are the fibers in FIG. 6 (after washing) at higher magnifications. Note the depth of the compound which permeated the surface of the fiber in FIG. 8 as can be seen in the cross section photograph.

Example 2

Preparation of a Sliver Incorporating Individual Fibers Associated with Metals and Metal Oxides A sliver is prepared so that it has a slight twist (around 4 twists per meter) and weighs 3 to 8 grams per meter. The sliver can be made from any staple fiber such as but not limited to cotton, rayon, polyester, or nylon. The sliver is run through the system described but just previous to the sliver being placed in the canals of the belt a very small amount of a predetermined chemical compound in the form of a fine powder, usually no more than 5 microns in size, is placed in the water and chemical delivery tank (32) or on the dry belt. The powder should be zinc or any form of zinc such as zinc oxide but in preferred embodiments should be zinc oxide with no less than a 97% purity level. Other metals and metal oxides can be used such as copper and/or its oxides or silver and/or its oxides by way of example. The amount of the predetermined chemical compound is not critical because the fiber will pick up what is given off by the irradiation and what is left in the canal will be collected after the wet process is complete. No more than 1 gram per meter of powder is required. The sliver travels along the conveyor belt for as little as 15 seconds but no more than 1 minute and is exposed to the irradiation during this period of time while it is in the liquid medium. A bubbling around the fibers will be observed which indicates the cavitation is taking place. The fibers in the sliver will immediately begin to drift within the canal and separate. It is this separation that will allow for complete coverage of the fibers with the predetermined chemical compound for deposition. It is important to make sure that the fibers remain orderly while in the canal and so rollers are preferably placed no less than every 30 to 50 centimeters to assure that the fibers remain submerged. The sonotrodes are activated just before the sliver and water and predetermined chemical compound are added to the conveyor belt. The sonotrodes will continue their work along the length of the conveyor belt which is adjusted to assure an even coating over 100% of the fibers. After the coating is complete the loose fibers are then quickly squeezed to remove almost all the water but more importantly to solidify the fibers into sliver once again so that it will have its own integrity which will allow it to be moved to the drying station.

The deposition of metal oxides rendered the treated fibers with both antimicrobial and UV inhibiting qualities. Antibacterial fabrics are widely used for production of outdoor clothes, under-wear, bed-linen, and bandages. UV inhibiting and antimicrobial resistance is very important in textile materials, having effects amongst others on comfort for the wearer. The deposition of metal oxides known to possess antimicrobial activity, namely TiO2, ZnO, MgO, CuO, Ag, and Ago, can significantly extend the end uses of textile fabrics and prolong the period of their use.

Copper oxide is widely cited in the literature for its antibacterial, antifungal, and antiviral qualities. It is also cited as an anti-mite fabric (The FASEB Journal, article 10.1096/fj.04-2029 Published online Sep. 9, 2004). Zinc has also been recognized as a mild antimicrobial agent, non-toxic wound healing agent, and sunscreen agent because it reflects both UVA and UVB rays (Godrey H. R. Alternative Therapy Health Medicine, 7 (2001) 49).

Antibacterial, wound healing, dust mite inhibition, medical compound delivery, and UV inhibition qualities can also be imparted to cellulose or polymeric fibers using an acoustic cavitated or sonochemical coating with the application of metal oxides.

The deposition of metal oxides is known for their various activities and in the present invention TiO2, ZnO, MgO, CuO, Ag, and AgO can be applied using the system described.

The use of metals and metal oxides is well documented for a variety of end uses and is described throughout the literature. However, the products that are produced using the normal treatment of a textile substrate limits greatly the applications of these metals to the various industries and healthcare applications.

The SEM photographs demonstrated herein show the adherence of copper oxide particles to the outside of the fiber which were cavitated to facilitate attachment of the copper oxide to the fibrous substrate as per the description above.

Described in the literature are treatments as follows:

Systems that use an oxidation reduction from a soluble metal on to a fiber or textile such as described in U.S. Pat. No. 5,981,006 Gabbay Application of a Metallized Textile.

Systems that include a metal oxide in a polymer by introduction of the compound through a carrier into a pre-extruded polymeric slurry such as described in US Patent Application 20080193496 Antimicrobial and Antiviral Polymeric Master Batch, Processes For Producing Polymeric Materials Therefrom and Products Produced Therefrom Systems that use sonochemical irradiation to woven or non-woven textile substrates such as described in IL 2009/00645 Gedanken et al. Sonochemical Coating of Textiles with Metal Oxide Nanoparticles for Antimicrobial Fabrics In treating at the fiber level the present invention provides for a greater control of dosage of the antimicrobial compounds or UV inhibition compounds. It was found that 30% of the fibers treated with a copper oxide in a fabric were sufficient to produce a homogenous pad that was effective as a wound healing device but in some cases less was sufficient. At the same time, other elements can be added to the pad, should they be desired, by simply adding different treated fibers. In theory, one could add a fire retardant (FR) quality to a fabric that is treated to destroy microbes which would find use in hospitals and public institutions.

Example 3 (Diatomaceous Earth and Organic Insoluble Compounds)

A sliver is prepared so that it has a slight twist (around 4 twists per meter) and weighs about 2 to about 20 grams per meter, and preferably about 3 to about 8 grams per meter. The sliver can be made from any staple fiber such as but not limited to cotton, rayon, polyester, and nylon. The sliver is run through the system described but just previous to the sliver being placed in the canals of the belt a very small amount of the predetermined chemical compound in the form of a fine powder, usually no more than 5 microns in size, is placed in the water and chemical delivery tank (32) or on the dry belt. The powder can be food grade diatomaceous earth with a purity level of no less than a 97%. Diatomaceous earth has been chosen for this example because it is approved by the EPA as a pesticide for use against the common bed bug, Cimexlectularius as well as other exo-skeletal pests such as fleas, ticks, beetles, roaches and mites.

As it applies to exo-skeletal bugs in general and bed bugs in particular, the normal application of diatomaceous earth is in loose powder form which is deposited as a powder between the folds of textiles in a mattress or on the floor so that the bed bugs will walk across the powder in order to reach its human target. Diatomaceous earth is fossilized/silicated diatoms. The powder has sharp edges which scrapes the exo-skeleton and causes dehydration of the bug. When the diatomaceous earth is cavitated into a fiber the same kill mechanism will be available to destroy the bug with the advantage that the user of the powder is not exposed to the loose powder about which there is a problem of exposure.

Furthermore, an organic compound that is encapsulated and is capable of withstanding the oscillation of the acoustic cavitation process can be used in the same manner as described for the application of diatomaceous earth or any of the compounds discussed herein. Powder size of the encapsulated compound can be as large as 15 microns which has been shown to still be within the acceptable parameters of the process as described above. Encapsulated compounds which protect soluble compounds is well known to those familiar with the art and are commonly used in protecting organic compounds from denaturing when in creams or aqueous solutions. Because the process is conducted at room temperature, the encapsulating material can be compounds such as but not limited to silicones, waxes, and cellulose based compounds which will not be affected by the heat of the process. A mechanism for removal of the encapsulate can be pressure, heat, or time which will then release the active ingredient embedded in the textile to the desired end use.

Examples of such encapsulated organic compounds include aroma oils to impart pleasant odors or to mask negative odors, nano-compounds or compounds such as nicotine for transdermal patches, antibiotics for bandages, or growth factors and other peptides as compound delivery systems. These compounds possess medicinal or cosmetic qualities that can be delivered by a patch, garment, or textile strip.

Example 4

Figure 9:
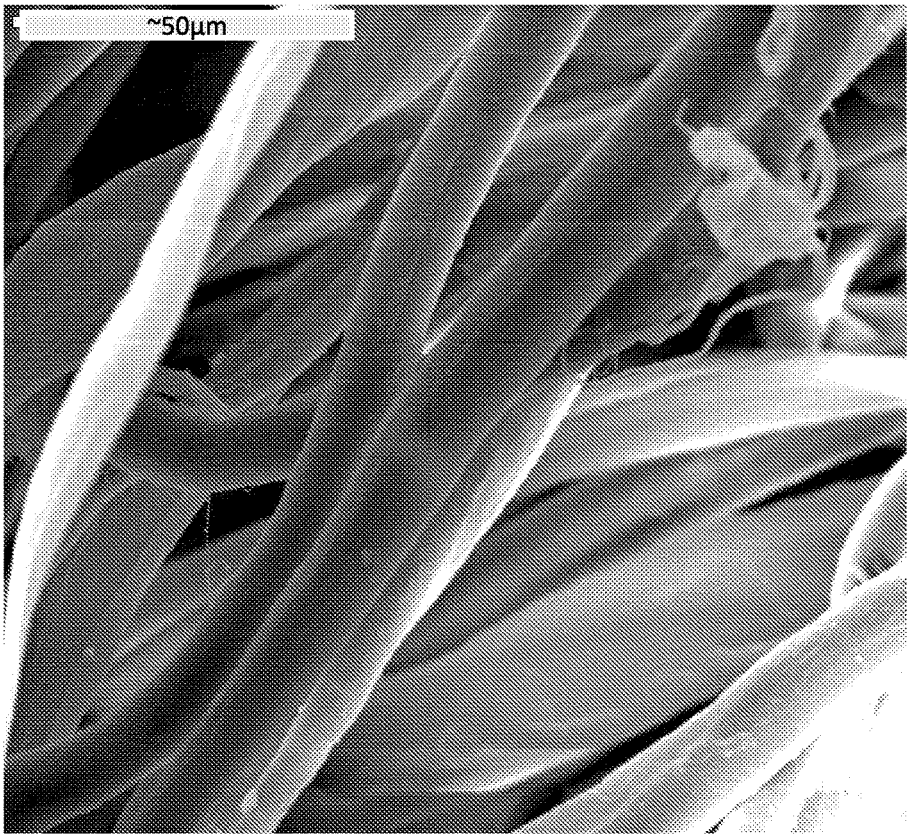
FIG. 9 is an SEM picture showing a chemically coated fiber using an oxidation/reduction process. Note the 100% coverage of the fiber.
Figure 10A:
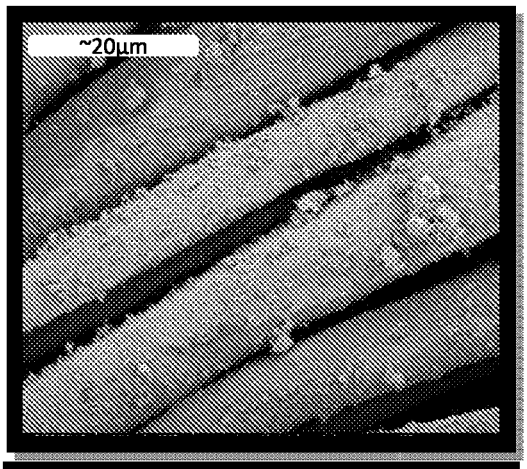
FIG. 10*a* is a 20 micron section of cavitated Ag4O4 (large particles) on a sonochemical nano deposition of a CuO on a copper plated cotton fiber
Figure 10B:
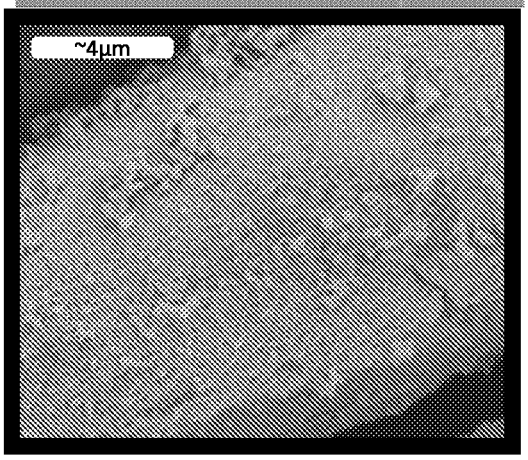
FIG. 10*b* is a 4 micron section of cavitated Ag4O4 (large particles) on a sonochemical nano deposition of a CuO on a copper plated cotton fiber
Figure 10C:
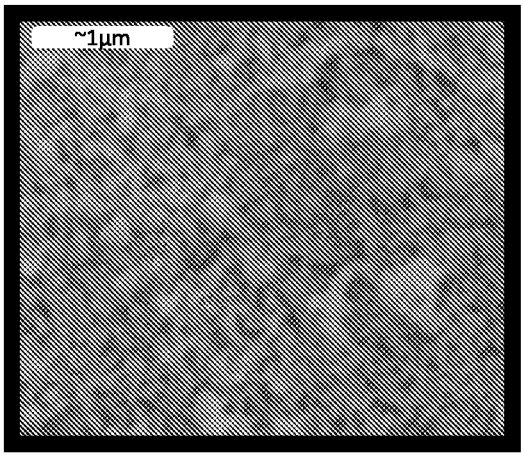
FIG. 10*c* is a 1 micron section of cavitated Ag4O4 (large particles) on a sonochemical nano deposition of a CuO on a copper plated cotton fiber

Slivers comprised of 100% cotton were maintained at room temperature and applied to an apparatus similar to that illustrated in FIG. 1. Ultrasonic cavitation was accomplished via a 1000 watt sonotrode, set at 24 Kh with a 15 seconds exposure, in total, while the sliver was immersed in a recess containing tap water. Silver nitrate crystals (97% pure) were added to the water and put into solution. This solution was now sprayed with the water in the canal. Ammonia was added to the water and the sonotrode was activated. As the reductant converted the silver nitrate to silver the acoustic waves immediately caused the chemical reduction process and then, immediately with the creation of the silver cavitation, which kept the silver particles from agglomerating, immediately attached them to the surface of the fibers as per (FIG. 10). In comparison, in FIG. 9 a reduction process is demonstrated using only a chemical reaction as per electroless plating. While the coating evenly covered the entire fiber it did not have a resistance to abrasion or washing and was easily removed from the surface of the fiber.

The same process was done with the alumina trihydrate but without a reduction process. The raw chemistry was added to the water before cavitation and the size of the particles that were placed in the water was the same as the particles after attachment to the fiber. The sonotrode was then activated and as can be seen in FIG. 5 the particles attached themselves to the fibers.

It will be evident to those skilled in the art that the invention is not limited to the details of the foregoing illustrative examples and attached figures and that the present invention may be embodied in other specific forms without departing from the essential attributes thereof, and it is therefore desired that the present embodiments and figures be considered in all respects as illustrative and not restrictive, reference being made to the appended claims, rather than to the foregoing description, and all changes which come within the meaning and range of equivalency of the claims are therefore intended to be embraced therein.

What is claimed is:

1. A surface treatment process for treating a plurality of cellulose fibers, comprising the steps of:

providing at least one predetermined inorganic particulate material in a liquid medium, said inorganic material remaining at least partly in particulate form in the medium;

placing sliver comprising cellulose staple fibers on a transporting means;

incrementally introducing the sliver into a trough within a surface treatment apparatus so that there is controlled dispersion of the sliver fibers transported within the liquid medium contained in the trough, the sliver transported on a moving double web with the fibers sandwiched therebetween thereby minimizing fiber dispersal and disorder in the liquid medium;

activating at least one transponder in acoustic communication with at least one sonotrode for generating sound pressure waves in the liquid medium which embed the inorganic particulates into the individual sliver fibers; and, reconstituting the fibers back to sliver.

2. A surface treatment process according to claim 1, wherein the at least one sonotrode emits sound pressure waves at a frequency of about 15 to about 30 KHz.

3. A surface treatment process according to claim 1, further comprising a step of adding a surfactant to the liquid medium in order to improve fiber separation during the surface treatment process and in order to assist in the reconstitution of the fibers to sliver form.

4. A surface treatment process according to claim 1 further comprising a step of winding the fibers after surface treatment, thereby facilitating reconstitution of the fibers to sliver form.

5. A surface treatment according to claim 1, wherein said at least one predetermined inorganic particulate material is a flame retarding compound containing waters of hydration for imparting non-ignition or retarded ignition properties to said fibers.

6. A surface treatment according to claim 5, wherein said flame retarding compound is a hydrated compound selected from a group consisting of, magnesium hydroxide, alumina trihydrate, and combinations thereof.

7. A surface treatment according to claim 1, wherein said at least one predetermined inorganic particulate material is an antimicrobial compound containing metals and/or oxides thereof for imparting antibacterial, antifungal, and/or antiviral properties to said fibers.

8. A surface treatment according to claim 1, wherein said at least one predetermined inorganic particulate material is selected from a group consisting of copper oxide, silver, silver oxides, zinc, zinc oxide, and combinations thereof for imparting pesticidal properties to said fibers.

9. A surface treatment according to claim 7, wherein said at least one inorganic particulate material is selected from a group consisting of copper, copper oxides, silver, silver oxides, and combinations thereof.

10. A surface treatment process for treating a plurality of cellulose fibers, comprising the steps of:

providing at least one predetermined inorganic particulate material in a liquid medium, said inorganic material remaining at least partly in particulate form in the liquid medium;

placing sliver comprising cellulose staple fibers on a transporting means;

incrementally introducing the sliver into a plurality of troughs within a surface treatment apparatus so that there is control of the sliver transported on a plurality of movable conveyors within the liquid medium contained in the plurality of troughs, each of the troughs is configured as an elongated canal positioned to be spaced apart and substantially parallel to, and operated in parallel with, the other canals, each canal is sized to accommodate one of the plurality of moving conveyors passing through the canal and to limit dispersion of the fibers therein;

supplying a plurality of weighted elements to constrain the fibers of the sliver so as to remain at least partially submerged in the liquid medium and to retain their parallel orientation as they are transported through the liquid medium in the canals;

activating at least one transponder in acoustic communication with at least one sonotrode for generating sound pressure waves in the liquid medium which embed the inorganic particulate material into the individual sliver fibers; and, reconstituting the fibers back to sliver.

11. A surface treatment process according to claim 10, wherein the at least one sonotrode emits sound pressure waves at a frequency of about 15 to about 30 KHz.

12. A surface treatment process according to claim 10, further comprising a step of adding a surfactant to the liquid medium in order to improve fiber separation during the surface treatment process and in order to assist in the reconstitution of the fibers to sliver form.

13. A surface treatment process according to claim 10, wherein said at least one predetermined inorganic particulate material is an antimicrobial compound containing metals and/or oxides thereof for imparting antibacterial, antifungal, and/or antiviral properties to said fibers.

14. A surface treatment process according to claim 10 wherein the plurality of weighted elements is a plurality of weighting wheels.

* * * * *